US006397787B1

(12) United States Patent
Yamada et al.

(10) Patent No.: US 6,397,787 B1
(45) Date of Patent: Jun. 4, 2002

(54) CATALYTIC COMBUSTION HEATER

(75) Inventors: Tomoji Yamada, Kariya; Shoji Hirose, Nissin; Shigeru Ogino, Toyota, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/509,564

(22) Filed: Jun. 15, 2000

(30) Foreign Application Priority Data

| | | |
|---|---|---|
| Oct. 16, 1997 | (JP) | 9-303669 |
| Nov. 13, 1997 | (JP) | 9-330956 |
| Jun. 4, 1998 | (JP) | 10-172265 |
| Aug. 3, 1998 | (JP) | 10-231179 |

(51) Int. Cl.[7] ..... F22B 23/06

(52) U.S. Cl. ..... 122/367.1; 122/4 D; 122/7 R; 165/299; 165/300

(58) Field of Search ..... 122/4 D, 7 R, 122/367.1, 367.3; 165/299, 300; 431/352, 353, 268, 12, 75, 78, 80, 145, 146

(56) References Cited

U.S. PATENT DOCUMENTS 5,746,159 A * 5/1998 Kobayashi et al. ..... 122/367.1
5,865,611 A * 2/1999 Maiello ..... 431/12
5,997,278 A * 12/1999 Sutton ..... 431/12

FOREIGN PATENT DOCUMENTS

| | | |
|---|---|---|
| DE | 196 01 957 | 7/1996 |
| EP | 0 740 111 | 10/1996 |
| EP | 0 798 512 | 10/1997 |
| JP | 57-131957 | 8/1982 |
| JP | 4-57072 | 5/1992 |
| JP | 5-223201 | 8/1993 |
| JP | 6-42720 | 2/1994 |

* cited by examiner

*Primary Examiner*—Jiping Lu
(74) *Attorney, Agent, or Firm*—Oblon, Spivak, McClelland, Maier & Neustadt, P.C.

(57) ABSTRACT

A catalytic combustion heater having, in a fuel gas flow passage in which an inflammable gas- and combustion support gas-containing fuel gas flows, tubes in which an object fluid to be heater flows, and an oxidation catalyst provided on outer surfaces of the tubes and contacting the fuel gas to generate an oxidation reaction, comprising a catalyst-carrying heat exchanger adapted to heat the object fluid with the oxidation reaction heat of the fuel gas, a detecting member adapted to detect the temperature of a combustion exhaust gas in the fuel gas flow passage to check whether the temperature is at the level of a dew point thereof or not, and a control unit adapted to control at least one of a feed rate of the combustion support gas, which is supplied to the fuel gas flow passage, and a feed rate of the inflammable gas.

4 Claims, 19 Drawing Sheets

CATALYTIC COMBUSTION HEATER

BACKGROUND OF THE INVENTION

The present invention relates to a catalytic combustion heater that heats fluid to be heated, which is a liquid or gas.

A so-called catalytic combustion heater, which causes an oxidation reaction of an flammable gas (fuel gas) with a catalyst and heats a fluid to be heated with the generated heat, is known, and various applications of the heater, such as home use and vehicular use, have been studied (e.g., Japanese Unexamined Patent Publication (KOKAI) No. Hei 5-223201).

A catalytic combustion heater has a catalyst-carrying heat exchanger having, in a flow passage of an flammable gas, tubes where an object fluid to be heated, which is a liquid or gas, flows, and multiple catalyst-carrying fins are integrally joined to the outer surfaces of the tubes. An oxidation catalyst, such as platinum or palladium is used for the multiple fins.

When the catalyst-carrying fins are heated to or above an activation temperature and contact the flammable gas, an oxidation reaction occurs on the surfaces of the fins. The oxidation reaction heat generated at that time is transferred from the fins into the tubes, thereby heating the object fluid that flows in the tubes.

The flammable gas is mixed with a combustion support gas (normally, air) for oxidizing the flammable gas, and the mixed gas is supplied as a fuel gas into the catalyst-carrying heat exchanger. The catalyst-oriented oxidation reaction occurs in widely varying range of the flammable gas concentration. Therefore, unburned gas that has not reacted upstream can be burned with a catalyst on the downstream side, and combustion can be carried out in the entire heat exchanger. This provides a compact and high-performance heater as compared with burner type heaters, which have been typical so far.

There is a type in which the direction of the flow of the flammable gas in a catalyst-carrying heat exchanger is opposite to the direction of the flow of the object fluid. In this case, as the slope of the concentration of the flammable gas coincides with the slope of the temperature of the object fluid, the heat exchanging efficiency can be improved. That is, since an inlet port for the object fluid is provided near the outlet of the fuel-gas flow passage, the heat of the exhaust gas can heat the object fluid efficiently by making the combustion exhaust gas, immediately before being discharged, contact the tubes where the cooler object fluid flows.

The feed rate of the combustion support gas is normally set in a range of about 1 to 5 times the amount necessary for oxidation. To improve the heat exchanging efficiency, it is preferred to reduce the flow rate of exhaust gas by making the feed rate as small as possible to thereby limit the dumping of the generated heat, unused, with the exhaust gas.

However, the combustion exhaust gas contains a considerable amount of vapor produced by the oxidation reaction, so that when the temperature of the combustion exhaust gas drops, the vapor may condense into droplets.

In the construction in which the direction of the flow of the flammable gas in a catalyst-carrying heat exchanger is opposite to the direction of the flow of the object fluid, particularly, the cooler object fluid is supplied near the outlet for the combustion exhaust gas as mentioned above. Therefore, vapor may condense on the surfaces of the low-temperature tubes and the surfaces of the fins that are integral to the tubes and wet the surface of the oxidation catalyst. In this case, there is a problem in that the oxidation catalyst becomes inactive, thus interfering with the oxidation reaction and causing unburned gas to be discharged.

If the feed rate of the combustion support gas is low, it becomes easier for the temperature of the catalyst to rise and the non-uniform distribution of the fuel gas may cause the catalyst temperature to exceed the combustion point (570° C. for hydrogen fuel) at the location where high-concentration flammable gas is supplied or the location where the object fluid does not flow smoothly, thus generating a flame. When a flame is produced, the catalyst may have heat deterioration (normally, the deterioration occurs at or above 700° C.), which lowers the catalytic performance. Because the catalyst reaction is caused in the entire heat exchanger as mentioned above, however, it is difficult to specify where a flame will be produced and it is hard to detect the flame.

According to the above conventional catalytic combustion heater, however, if the catalyst on the upstream side of the fuel-gas flow passage is not sufficiently active at the time the heater is activated, unreacted fuel gas (unburned fuel gas) may be discharged or keep flowing downstream and become a high-concentration fuel gas, which may contact the oxidation catalyst in the vicinity of the outlet of the fuel-gas flow passage and may spontaneously react with it and cause a fire. One way to prevent this is to gradually raise the temperature of the tubes and fins at the individual portions of the fuel-gas flow passage while monitoring those temperatures. This method complicates the structure and extends the activation time longer.

Further, there are expected applications of a catalytic combustion heater, which burns an flammable fuel gas using an oxidation catalyst and heats an object fluid using the generated heat, such as home use and vehicular use. In such a catalytic combustion heater, a combustion support gas is supplied from one of the open ends of a cylindrical housing having openings at both ends and a fuel-gas feeding section injects the fuel gas from an injection port formed inside the housing, thereby producing a flow of the mixture of the fuel gas and the combustion support gas in the housing. Tubes in which an object fluid to be heated, such as water, flows are located in the housing, and a catalyst section, such as fins carrying an oxidation catalyst, is formed on the outer surfaces of the tubes, thus constituting a catalyst-carrying heat exchanger. The fuel gas that contacts the catalyst section causes an oxidation reaction there, thus causing catalyst combustion. The combustion heat caused by the catalytic combustion is received by the object fluid through the walls of the tubes and is used for heating.

Further, when the combustion output becomes high, a flame is produced, resulting in vapor phase combustion. Since the vapor phase combustion has a higher combustion temperature than the catalytic combustion, it deteriorates the heater, which causes problems such as reducing heat exchanging efficiency and lowering the heating performance. There is a model that has a temperature sensor provided in the catalyst section to detect a temperature rise in the catalyst section from which vapor phase combustion is detected. Even when vapor phase combustion occurs, the detected temperature does not necessarily rise to a level that is considered abnormal unless the temperature sensor is exposed to a flame. When a very small part of the catalyst becomes abnormally hot and a flame is locally produced, therefore, occurrence of vapor phase combustion cannot be detected. In addition, since a threshold value for the detected temperature for determining if vapor phase combustion has occurred is naturally set higher than the temperature of the catalyst section at the time of normal catalytic combustion, it is not possible to detect the occurrence of vapor phase combustion with sufficient precision.

In view of the above problems, it is an object of the present invention to provide a catalytic combustion heater that prevents the activation of an oxidation catalyst from being lowered by condensation of vapor, prevents the catalyst from being deteriorated by the occurrence of a flame, demonstrates sufficient catalytic performance, has excellent heat exchanging efficiency and is safe and highly reliable.

In view of the above problems, it is another object of the present invention to provide a safe and quick-activating catalytic combustion heater that can activate the whole catalyst-carrying heat exchanger quickly with a simple structure while preventing discharge of unburned gas and a fire.

In view of the above problems, it is a further object of the present invention to provide a catalytic combustion heater that can detect the occurrence of vapor phase combustion with high precision.

SUMMARY OF THE INVENTION

A catalytic combustion heater according to the present invention includes a catalyst-carrying heat exchanger. The heat exchanger has a fuel-gas flow passage, in which a fuel gas flows. The fuel gas includes a flammable gas and a combustion support gas. Tubes, in which an object fluid to be heated flows, are located within the fuel-gas flow passage. An oxidation catalyst, which is provided on outer surfaces of the tubes, causes an oxidation reaction when the fuel gas contacts the outer surfaces. The catalyst-carrying heat exchanger heats the object fluid with the oxidation reaction heat of the fuel gas. Further included is a detecting section for detecting whether or not the temperature of a combustion exhaust gas in the fuel-gas flow passage has reached its dew-point temperature. Further included is a control section for controlling at least one of the feed rate of the combustion support gas and that of the flammable gas supplied to the fuel-gas flow passage, based on a result of detection by the detecting section.

The detecting section is one of a temperature detecting section for detecting the temperature of the combustion exhaust gas and a temperature detecting section for detecting temperatures-of the outer surfaces of the tubes.

The detecting section is provided in the vicinity of an outlet of the fuel-gas flow passage.

The oxidation catalyst is carried by fins joined to the outer surface of the tubes and the temperature detecting section for detecting the temperatures of the outer surfaces of the tubes is a surface temperature detecting section for detecting surface temperatures of the fins in the vicinity of an outlet of the fuel-gas flow passage.

When the detecting section outputs a detection result such that the temperature of the combustion exhaust gas in the fuel-gas flow passage is equal to or lower than a dew-point temperature, which is determined by the composition of the fuel gas to be supplied, the control section performs control to increase the feed rate of the combustion support gas to raise the temperature of the combustion exhaust gas to or above the dew-point temperature.

When the detecting section outputs a detection result indicating that the temperature of the combustion exhaust gas in the fuel-gas flow passage is equal to or lower than a dew-point temperature, which is determined by the composition of the supplied fuel gas, the control section increases the feed rate of the flammable gas to a downstream part of the fuel-gas flow passage to raise the temperature of the combustion exhaust gas to or above the dew-point temperature.

The catalytic combustion heater further includes an flammable-gas feeding section having a plurality of flammable-gas feed ports, for distributing the flammable gas to an upstream part and a downstream part of the fuel-gas flow passage, and a valve member, which is located in the flammable-gas feeding section, for regulating the flow rate of the flammable gas supplied to the downstream side of the fuel-gas flow passage, and the control section adjusts the position of the valve member.

The flow direction of the fuel gas is opposite to the flow direction of the object fluid.

The combustion support gas is air.

Another catalytic combustion heater according to the present invention includes a catalyst-carrying heat exchanger. The heat exchanger has a fuel-gas flow passage, in which a fuel gas flows. The fuel gas includes a flammable gas and a combustion support gas. Tubes, in which an object fluid to be heated flows, are located within the fuel-gas flow passage. An oxidation catalyst, which is provided on outer surfaces of the tubes, causes an oxidation reaction when the fuel gas contacts the outer surfaces. The catalyst-carrying heat exchanger heats the object fluid with the oxidation reaction heat of the fuel gas. Further included is a detecting section for detecting the concentration of nitrogen oxide contained in the combustion exhaust gas in the fuel-gas flow passage and a control section for controlling at least one of the feed rate of the combustion support gas and that of the flammable gas supplied to the fuel-gas flow passage, based on a result of detection by the detecting section.

In this catalytic combustion heater according to the present invention, the detecting section is provided in the vicinity of an outlet of the fuel-gas flow passage.

In the another catalytic combustion heater according to the present invention, when the detecting section detects that the concentration of the nitrogen oxide is equal to or higher than a given value, the control section decreases the feed rate of the flammable gas or increases the feed rate of the combustion support gas.

A further catalytic combustion heater according to the present invention includes a catalyst-carrying heat exchanger. The heat exchanger has a fuel-gas flow passage, in which a fuel gas flows. The fuel gas includes a flammable gas and a combustion support gas. Tubes, in which an object fluid to be heated flows, are located within the fuel-gas flow passage. An oxidation catalyst, which is provided on outer surfaces of the tubes, causes an oxidation reaction when the fuel gas contacts the outer surfaces. The catalyst-carrying heat exchanger heats the object fluid with the oxidation reaction heat of the fuel gas. Further included is a plurality of flammable-gas feeding passages with different passage resistances for distributing the flammable gas to an upstream part and downstream part of the fuel-gas flow passage, whereby the passage resistances of the plurality of flammable-gas feeding passages are such that when an amount of heat generated in a downstream part of the fuel-gas flow passage is a minimum output of the catalytic combustion heater, the temperature of combustion exhaust gas in the fuel-gas flow passage becomes equal to or higher than a dew-point temperature that is determined by the composition of the fuel gas.

A different catalytic combustion heater according to the present invention includes a catalyst-carrying heat exchanger. The heat exchanger has a fuel-gas flow passage, in which a fuel gas flows. The fuel gas includes a flammable gas and a combustion support gas. Tubes, in which an object fluid to be heated flows, are located within the fuel-gas flow passage. An oxidation catalyst, which is provided on outer surfaces of the tubes, causes an oxidation reaction when the fuel gas contacts the outer surfaces. The catalyst-carrying heat exchanger heats the object fluid with the oxidation reaction heat of the fuel gas. Further included is a detecting section for detecting the temperature of combustion exhaust gas or the concentration of the flammable gas in the vicinity of an outlet of the fuel-gas flow passage and a flow-rate control section for controlling the flow rate of the flammable gas based on the result of a detection of the detecting section.

In this catalytic combustion heater, according to the present invention, the flow-rate control section makes the flow rate of the flammable gas less than that of the combustion support gas until the temperature of the combustion exhaust gas detected by the detecting section exceeds a predetermined temperature or until the concentration of the flammable gas becomes lower than a predetermined concentration. The flow-rate control section increases the flow rate of the flammable gas to a predetermined level when the temperature of the combustion exhaust gas exceeds the predetermined temperature or when the concentration of the flammable gas becomes lower than the predetermined concentration.

In this catalytic combustion heater, according to the present invention, the catalyst-carrying heat exchanger has a fuel distributing section for distributing the flammable gas, the amount of which corresponds to a state of the object fluid flowing in the tubes to individual parts of the tubes.

A still different catalytic combustion heater according to the present invention includes a cylindrical housing having openings at both ends, and a combustion support gas is supplied from one of the open ends. Also included is a fuel-gas feeding section for feeding fuel gas into the housing from an injection port, which is formed toward inside the housing. Included is a catalyst-carrying heat exchanger having a plurality of tubes. The heat exchanger is provided downstream of the injection port in the housing. An object fluid, which is to be heated flows in the tubes. A catalyst section, which is formed on outer surfaces of the tubes, causes an oxidation reaction when contacting the fuel gas. A temperature detecting section provided in the housing in the vicinity of the injection port and closer to the above-mentioned open end than the tubes.

In this catalytic combustion heater according to the present invention, the temperature detecting section is provided on a projection of the fuel-gas feeding section protruding into the housing.

DETAILED DESCRIPTION OF THE PREFERRED EMBODIMENTS

Preferred embodiments of a catalytic combustion heater according to the present invention will now be described with reference to the accompanying drawings.

First Embodiment

Figure 1:
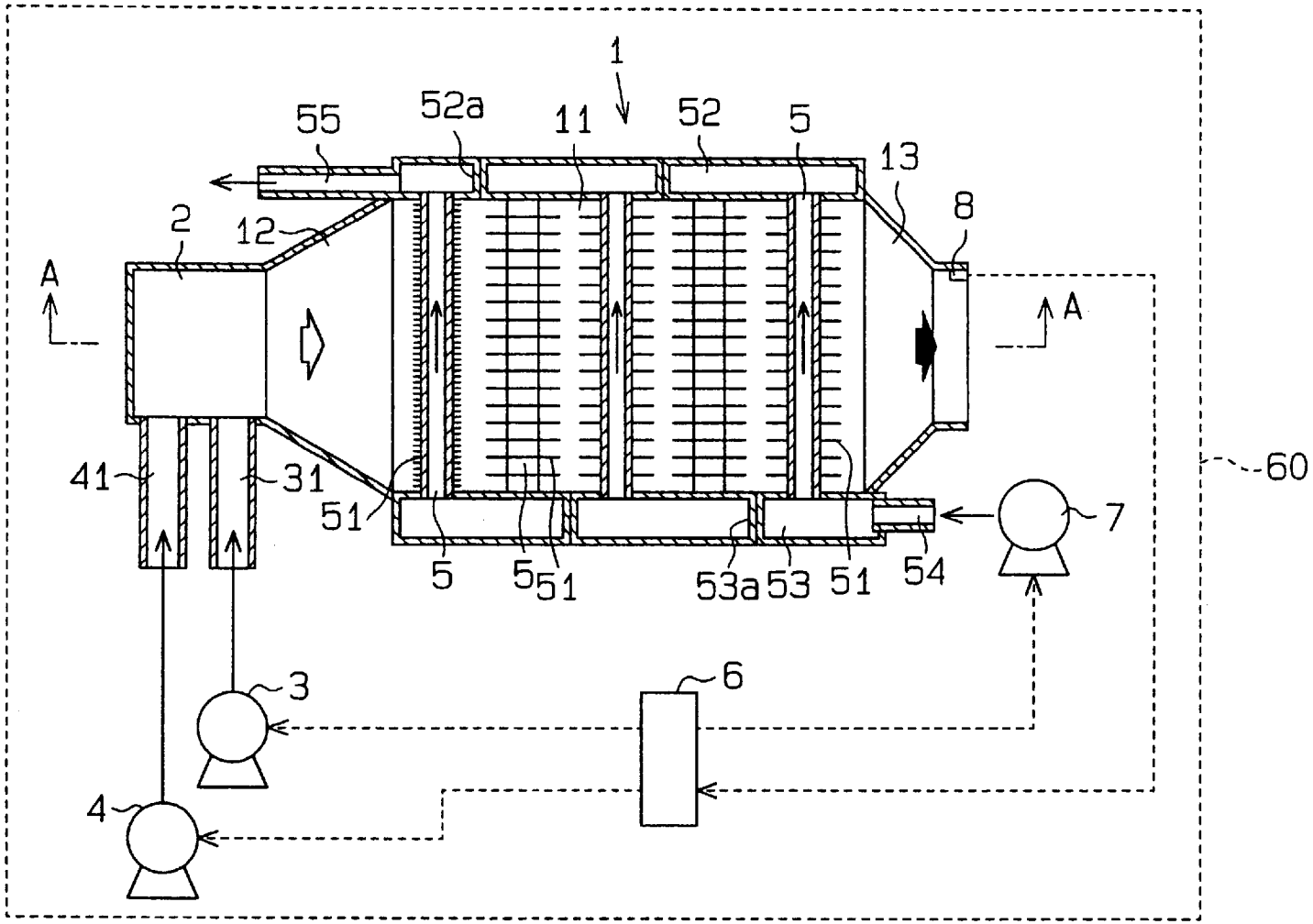
FIG. 1 is a diagram showing a catalytic combustion heater 60 according to a first embodiment.

FIG. 1 is a diagram showing a catalytic combustion heater 60 according to the first embodiment.

The catalytic combustion heater 60 includes a catalyst-carrying heat exchanger 1, a control unit 6 and a temperature detector 8.

The catalyst-carrying heat exchanger 1 has a fuel-gas flow passage 11 in a cylindrical container, both ends of which are open, and fuel gas flows toward an exhaust-gas port 13 (in the direction indicated by the arrows in the diagram) at the right end from a fuel-gas feed port 12 at the left end.

Coupled to the fuel-gas feed port 12 is a cylindrical body, the left end of which is closed. The cylindrical body forms a fuel-gas feeding section 2, the bottom wall of which is connected to a fuel feed passage 31, which communicates with a fuel feeding unit 3, and a combustion support-gas feed passage 41, which communicates with a combustion support-gas feeding unit 4.

An flammable gas, which is a fuel, is supplied from the fuel feeding unit 3, and a combustion support gas is supplied from the combustion support-gas feeding unit 4. Those gases are mixed in the fuel-gas feeding section 2, and the mixture is supplied as fuel gas into the fuel-gas flow passage 11 from the fuel-gas feed port 12.

For example, an flammable gas such as hydrogen or methanol is used as the fuel, and air is normally used as a combustion support gas. The feed rates of the flammable gas and the combustion support gas are controlled by the control section, or control unit 6. It is preferred that the feed rate of the combustion support gas in the fuel gas should be in a range of about 1 to 5 times the theoretical amount of air that is needed to oxidize the entire flammable gas and should be set as small as possible within a range where it does not exceed the heat-resisting temperature of a catalyst to efficiently recover the generated heat during normal combustion. However, when it is probable that the vapor in the combustion exhaust gas will condense, the control unit 6 increases the amount of combustion support gas, as will be discussed later.

Figure 2:
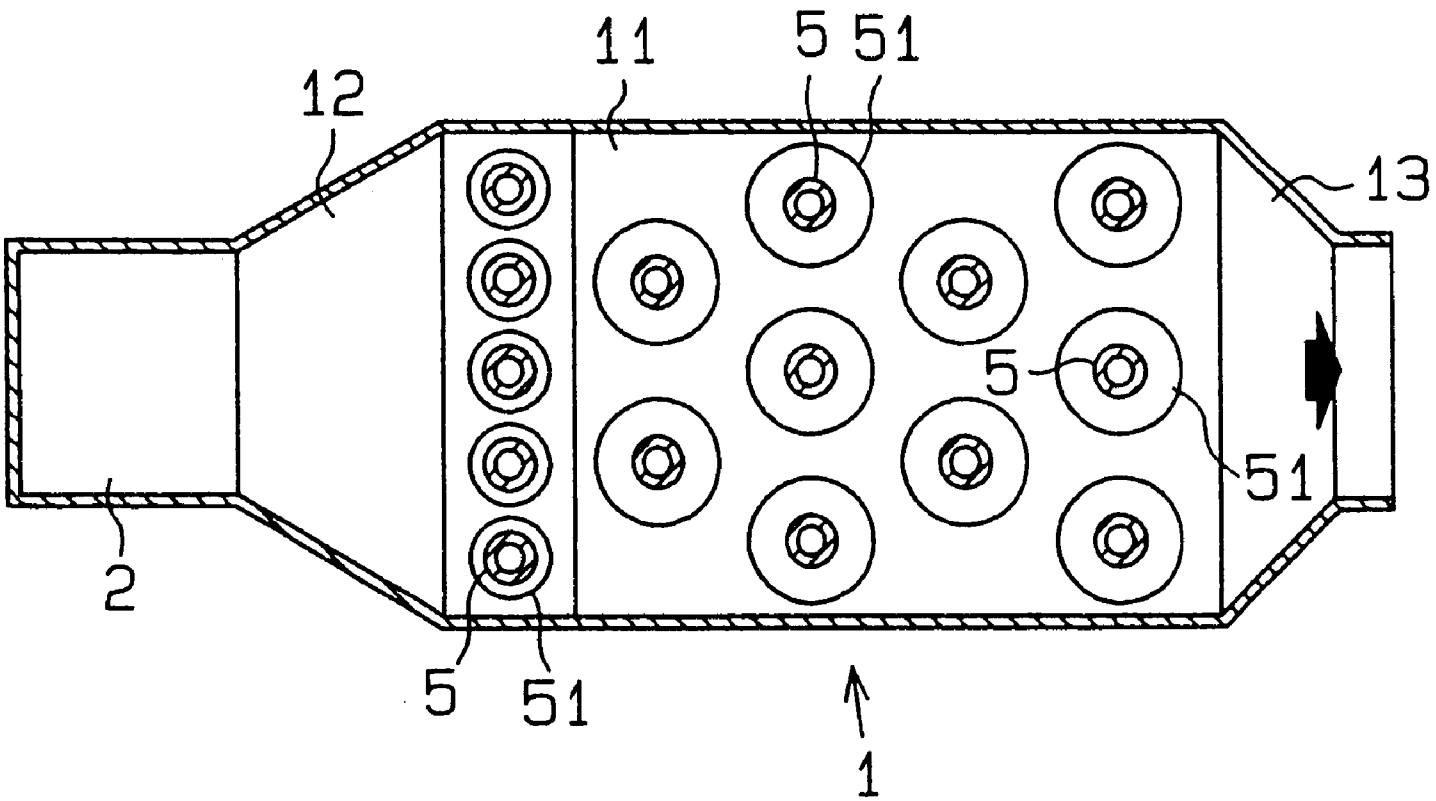
FIG. 2 is a diagram depicting a cross section when a catalyst-carrying heat exchanger 1 in the catalytic combustion heater 60 shown in FIG. 1 is cut along the line A—A.

FIG. 2 is a diagram depicting a cross section when the catalyst-carrying heat exchanger 1 in the catalytic combustion heater 60 shown in FIG. 1 is cut along the line A—A.

As shown in FIG. 2, rows of tubes 5 where the object fluid flows are provided in the fuel-gas flow passage 11 of the catalyst-carrying heat exchanger 1 in the flow path of the fuel gas. Multiple annular fins 51 are integrally connected to the outer surface of each tube 5 by brazing or the like. An oxidation catalyst such as platinum or palladium is carried on the surfaces of the fins 51, and an oxidation reaction occurs when the fuel gas contacts the surface of the oxidation catalyst. The heat generated by the oxidation reaction is transferred to the tubes 5 from the fins 51 to heat the object fluid that flows inside the tubes 5.

As shown in FIG. 1, both ends of the multiple tubes 5 are respectively coupled to tube joining sections 52 and 53 provided at the top and bottom portions of the catalyst-carrying heat exchanger 1. Partitions 52*a* and 53*a* are respectively formed at plural locations in the tube joining sections 52 and 53 to separate them into a plurality of sections.

An inlet pipe 54 for the object fluid is coupled to the right end of the lower tube joining section 53, and an outlet pipe 55 for the object fluid is coupled to the left end of the upper tube joining section 52. This forms a passage for the object fluid that is directed toward the upstream end from the downstream end of the fuel-gas flow passage as indicated by the arrows in FIG. 1. The object fluid is introduced from the inlet pipe 54 by an object fluid feeding unit 7, is heated to a high temperature as it flows in the tubes 5 and the tube joining sections 52 and 53, and is led outside from the outlet pipe 55. As the object fluid, for example, water is used and its feed rate is controlled by the aforementioned control unit 6.

The outside diameter of and the number of the fins 51 provided on the outer surfaces of the tubes 5 are properly set in accordance with the amount of heat needed for the object fluid in the joined tubes 5. According to this embodiment, the outside diameter of the fins 51 is smaller (FIG. 2) in a row of the tubes 5 located at the most upstream end of the fuel-gas flow passage 11. Because the object fluid in the tubes has a high temperature at the upstream end of the fuel-gas flow passage 11, the surface area of the fins 51 is made smaller to limit heat generation, so that the fins 51 and the tubes 5 are not heated more than necessary.

It is preferred that the number of the tubes 5 in each row increases toward the upstream end. This is because when the liquid object fluid is heated and is transformed into a vapor, it expands, and the pressure loss becomes large unless the total cross-sectional area is large. If the individual tubes 5 are arranged alternately so as to be positioned between tubes of the adjacent row, the effective length of the fuel-gas flow passage 11 becomes longer, thus improving the heat exchanging efficiency.

The temperature detector 8, which detects whether or not the combustion exhaust gas is at a dew-point temperature, is provided on the pipe wall of the exhaust-gas port 13 of the fuel-gas flow passage 11. The temperature detector 8 is designed to detect the temperature of the combustion exhaust gas in the vicinity of the outlet of the fuel-gas flow passage.

A known temperature sensor can be used as the temperature detector 8, and the temperature detector 8 may be provided on the surface of the fin 51 located at the lowermost position in the fuel-gas flow passage 11 to detect the surface temperature of the fin 51, instead of providing it on the pipe wall of the exhaust-gas port 13.

In this embodiment, the control unit 6 controls the feed rate of the combustion support gas based on the result of the detection. The control method will be described below by referring to FIGS. 3A, 3B and 4.

Figure 3A:
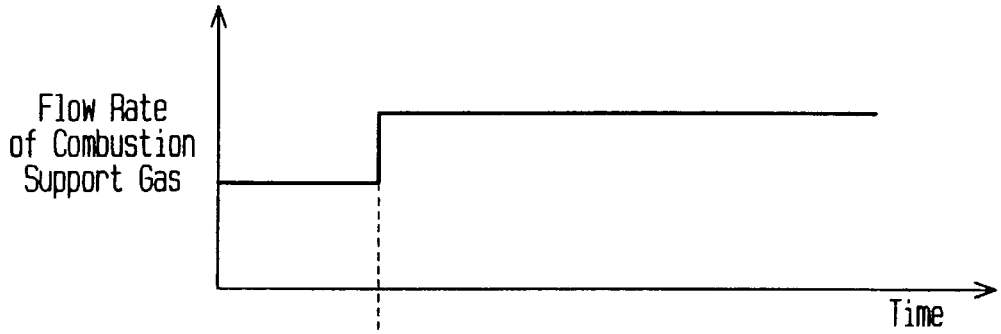
FIG. 3A is a diagram showing the relationship between the flow rate of a combustion support gas and time.
Figure 3B:
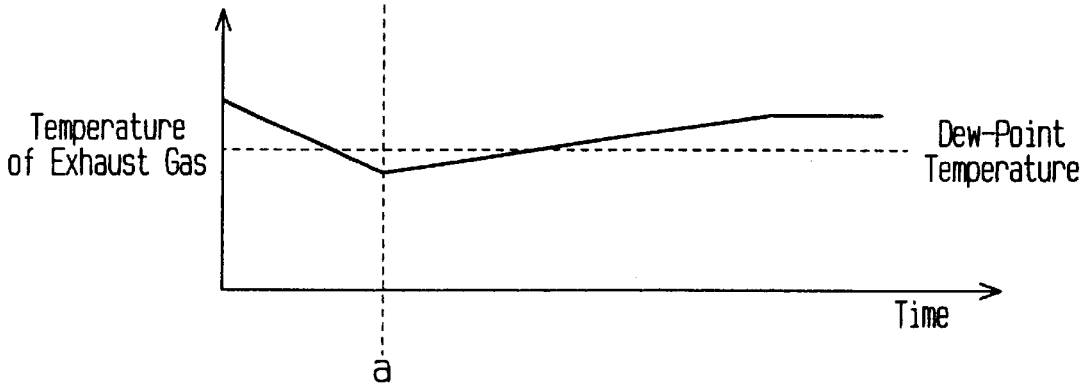
FIG. 3B is a diagram showing the relationship between the temperature of an exhaust gas and time.

FIG. 3A is a diagram showing the relationship between the flow rate of the combustion support gas and time, and FIG. 3B is a diagram showing the relationship between the temperature of the exhaust gas and time.

In the catalytic combustion heater 60, the advancing direction of the object fluid is opposite to the flow direction of the fuel gas. The temperature of the object fluid is lower toward the downstream end of the fuel-gas flow passage, i.e., near the exhaust-gas port 13. This causes the combustion exhaust gas to contact the tubes 5 where cooler object fluid flows, which makes it possible to efficiently recover the heat in the exhaust gas, thus ensuring a high heat exchanging efficiency.

However, a considerable amount of vapor produced by the oxidation reaction of the flammable gas in the upstream end may condense in the vicinity of the exhaust-gas port 13, where the low-temperature object fluid is supplied, and may cover the surface of the catalyst, thereby interfering with the contact of the flammable gas with the catalyst. In this embodiment, therefore, as shown in FIG. 3B, when the temperature of the combustion exhaust gas that is detected by the temperature detector 8 becomes lower than the dew-point temperature (time a in FIG. 3B), the control unit 6 increases the feed rate of the combustion support gas to raise the temperature of the exhaust gas.

Figure 4:
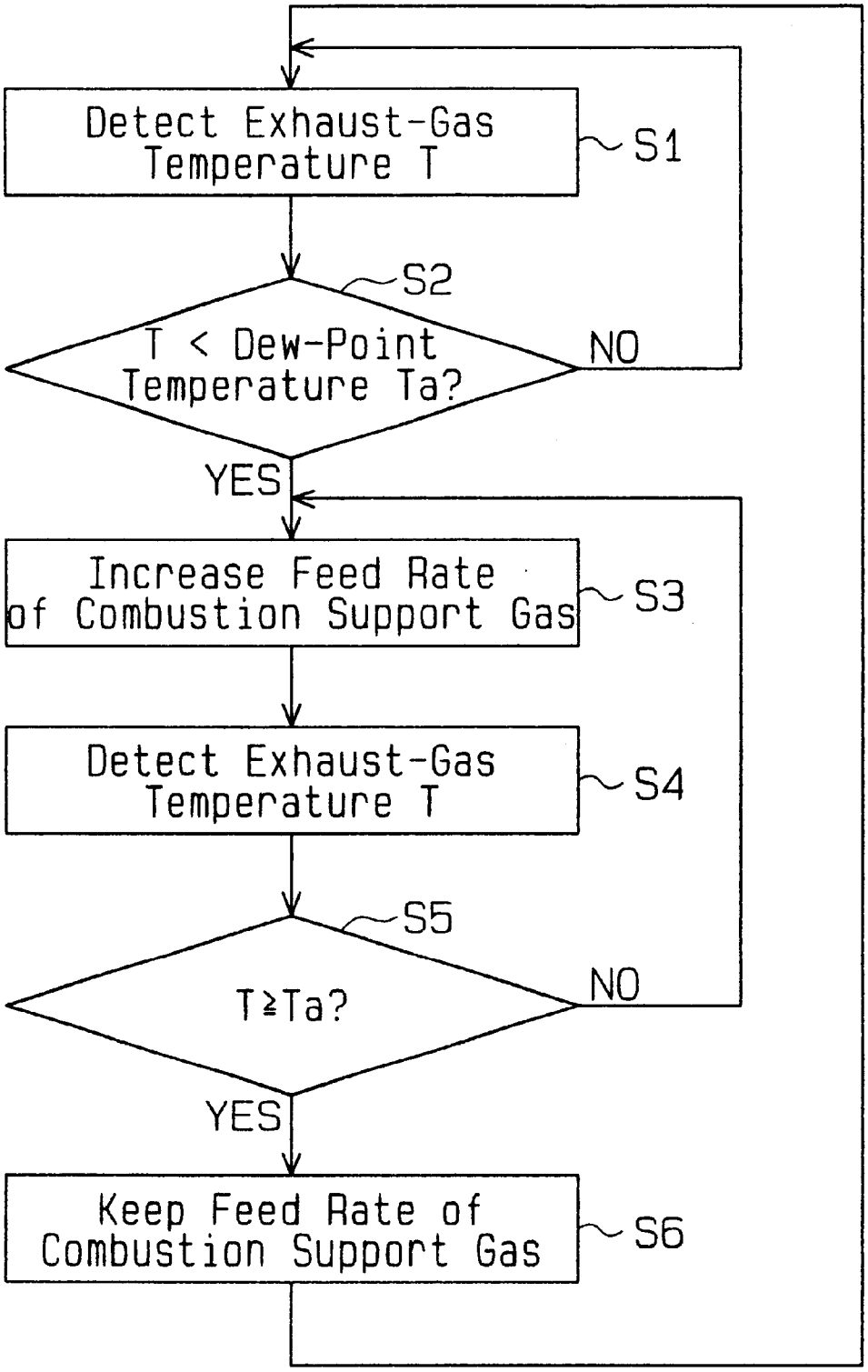
FIG. 4 is a flowchart illustrating the operation of the catalytic combustion heater 60.

FIG. 4 is a flowchart illustrating the operation of the catalytic combustion heater 60.

The temperature detector 8 detects the temperature of the combustion exhaust gas (step S1), and the control unit 6 determines if the temperature T is lower than a dew-point temperature Ta, which is determined by the composition of the fuel gas (the dew-point temperature is calculated based on the amount of vapor produced by the combustion of the flammable gas) (step S2).

When T<Ta is met in step S2, the control unit 6 outputs a control signal to the combustion support-gas feeding unit 4 to increase the feed rate of the combustion support gas by a predetermined amount (step S3). This increases the gas flow rate, which increases the transfer rate of heat generated on the surfaces of the fins 51 to the fuel gas or the combustion exhaust gas. When T<Ta is not met in step S2, the routine goes to step S1.

The temperature detector 8 detects the temperature of the combustion exhaust gas (step S4). The control unit 6 determines if T≧Ta (step S5).

When T≧Ta is not met in step S5, the routine goes to step S3. That is, since the control unit 6 repeats increasing the feed rate of the combustion support gas in step S3, the gas temperature at the downstream end of the fuel-gas flow passage 11 is increased to or above the dew-point temperature Ta (e.g., 73° C. for hydrogen).

When T≧Ta is met in step S5, the control unit 6 outputs a control signal to the combustion support-gas feeding unit 4 to maintain the feed current rate of the combustion support gas (step S6). If the temperature of the combustion exhaust gas is increased more than necessary, the heat transfer efficiency drops. Therefore, the control unit 6 controls the feed rate of the combustion support gas such that the temperature T detected by the temperature detector 8 becomes slightly higher than the dew-point temperature Ta.

According to this embodiment, as described above, even when the catalyst-carrying heat exchanger 1 is constructed such that the advancing direction of the object fluid is opposite to the flow direction of the fuel gas, the temperature of the combustion exhaust gas falls to prevent vapor from condensing. This prevents the catalyst from becoming inactive, which would cause unburned gas to be discharged. This improves reliability and ensures a high heat transfer efficiency.

Second Embodiment

The second embodiment of the present invention will be discussed below.

Figure 5:
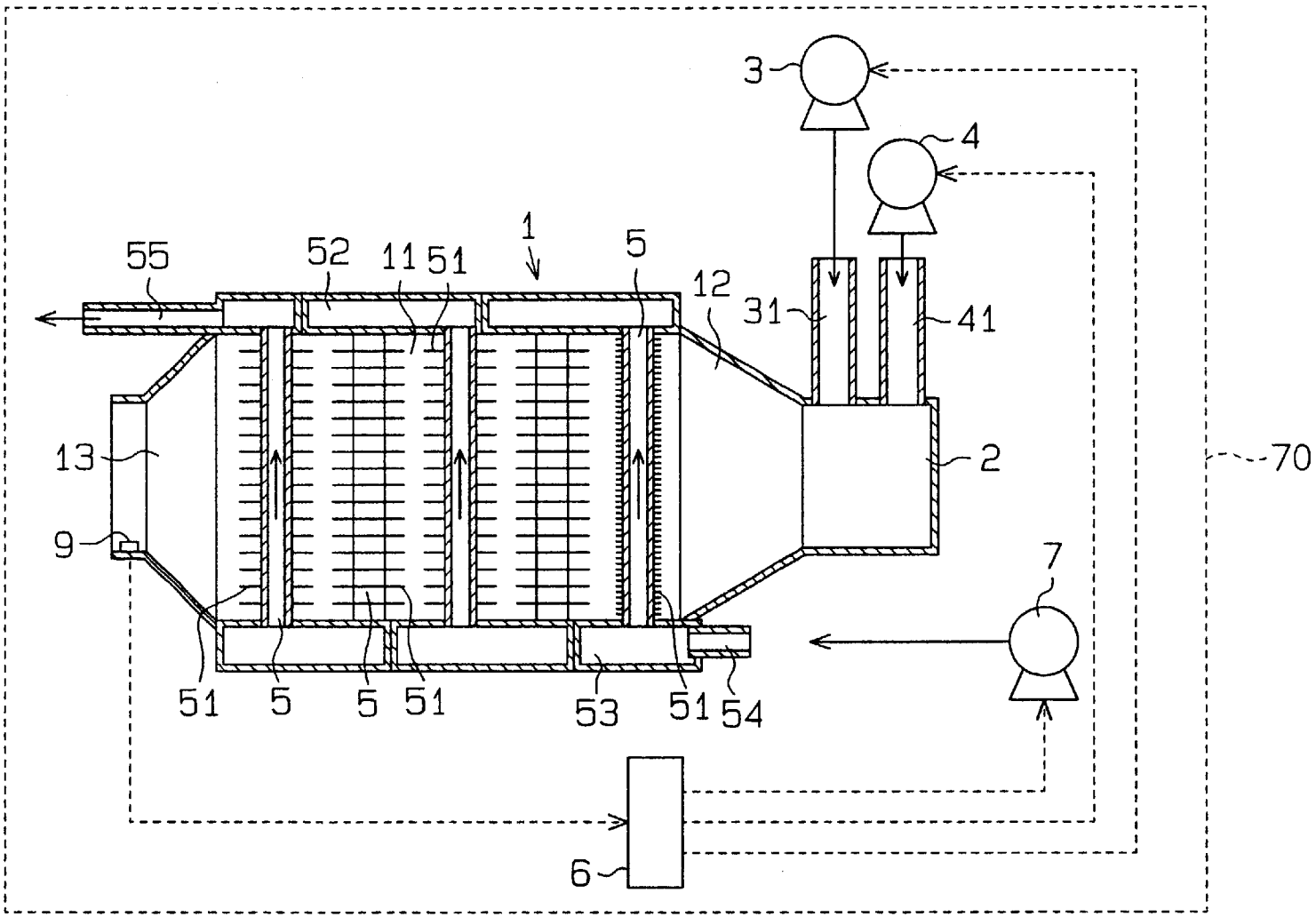
FIG. 5 is a diagram showing a catalytic combustion heater 70 according to a second embodiment.

FIG. 5 is a diagram showing a catalytic combustion heater 70 according to the second embodiment.

The catalytic combustion heater 70 includes the catalyst-carrying heat exchanger 1, the control unit 6 and an $NO_x$ detector 9. The basic construction of this embodiment is substantially the same as that of the first embodiment, except that the $NO_x$ detector 9 is used in place of the temperature detector 8 of the first embodiment. The following will mainly describe the difference.

In this embodiment, the flow direction of the object fluid is the same as that of the fuel gas, and the fuel-gas feeding section 2 is provided at the right end of the catalyst-carrying heat exchanger 1. The fuel gas flows in the fuel-gas flow passage 11 from right to left in FIG. 5.

The number of the fins 51 is increased for the tubes 5 on the upstream side (rightward in FIG. 5). In this embodiment, because the flow direction of the object fluid is the same as that of the fuel gas, even if a considerable amount of heat is produced by the fuel-rich gas, the heat is absorbed by the low-temperature object fluid so that the object fluid can be heated efficiently.

According to the structure of the catalytic combustion heater 70, the closer a location is to the exhaust-gas port 13, the higher the temperature of the object fluid at that location is, which reduces the possibility that the activation of the catalyst will be lowered by the condensation of vapor in the combustion exhaust gas. However, the structure is such that, if a flame is produced in the catalyst-carrying heat exchanger 1 by a partial increase in the concentration of the flammable gas in the fuel gas, the flame is not easily detected.

In this embodiment, therefore, the $NO_x$ detector 9, which detects a nitrogen oxide ($NO_x$) in the combustion exhaust gas, is provided on the pipe wall of the exhaust-gas port 13 of the fuel-gas flow passage 11. Based on the result from the $NO_x$ detector 9, the control unit 6 controls the feed rates of the gases. When a flame is produced in the catalyst-carrying heat exchanger 1, $NO_x$, which is not produced in normal catalytic combustion, is produced. It is possible to detect if a flame has been produced from whether or not $NO_x$ has been produced. A known $NO_x$ sensor 43 is used as the $NO_x$ detector 9.

The control method of the catalytic combustion heater 70 will be discussed below.

Figure 6A:
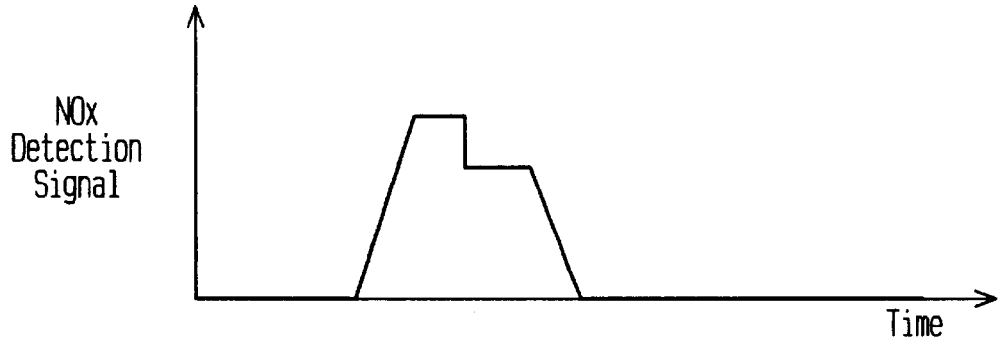
FIG. 6A is a diagram showing the relationship between an $NO_x$ detection signal detected by an $NO_x$ detector 9 and time.
Figure 6B:
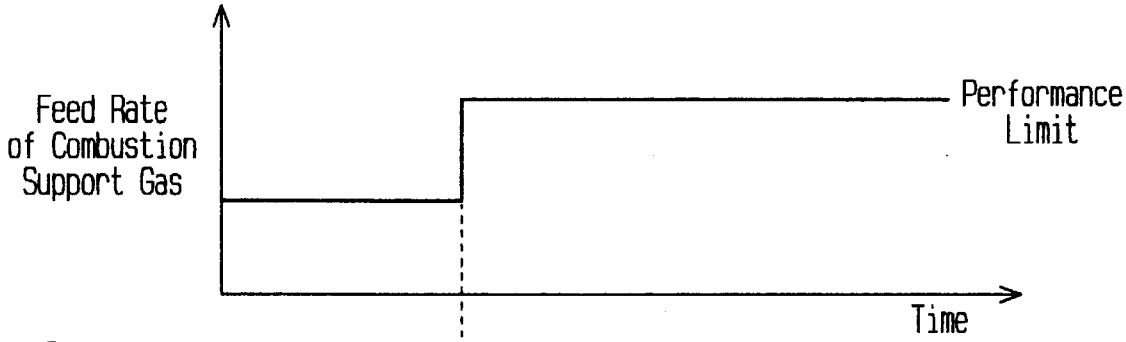
FIG. 6B is a diagram showing the relationship between the feed rate of a combustion support gas and time.
Figure 6C:
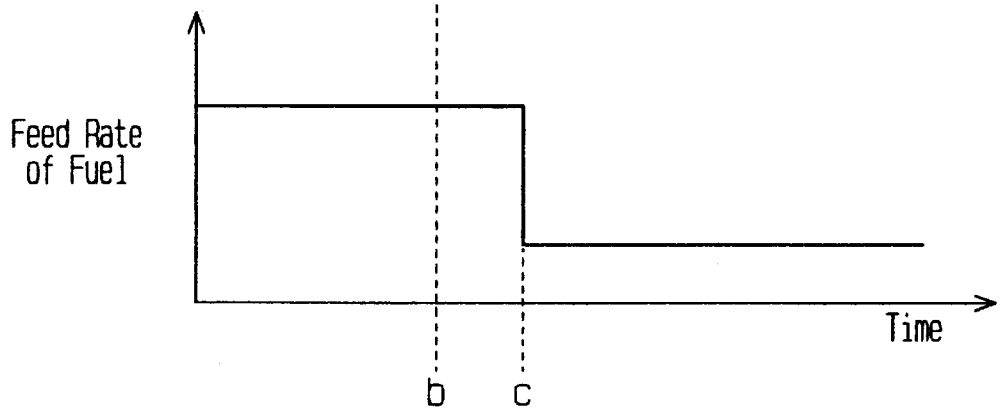
FIG. 6C is a diagram showing the relationship between the feed rate of a fuel and time.

FIG. 6A is a diagram showing the relationship between an $NO_x$ detection signal detected by the $NO_x$ detector 9 and time, FIG. 6B is a diagram showing the relationship between the feed rate of the combustion support gas and time, and FIG. 6C is a diagram showing the relationship between the feed rate of the fuel and time. Here, the feed rate of the flammable gas (fuel) from the fuel feeding unit 3 and the feed rate of the combustion support gas from the combustion support-gas feeding unit 4 have previously been determined, as shown in FIGS. 6B and 6C, in accordance with the type of the fuel, the shape of the heat exchanger and so forth.

Figure 7:
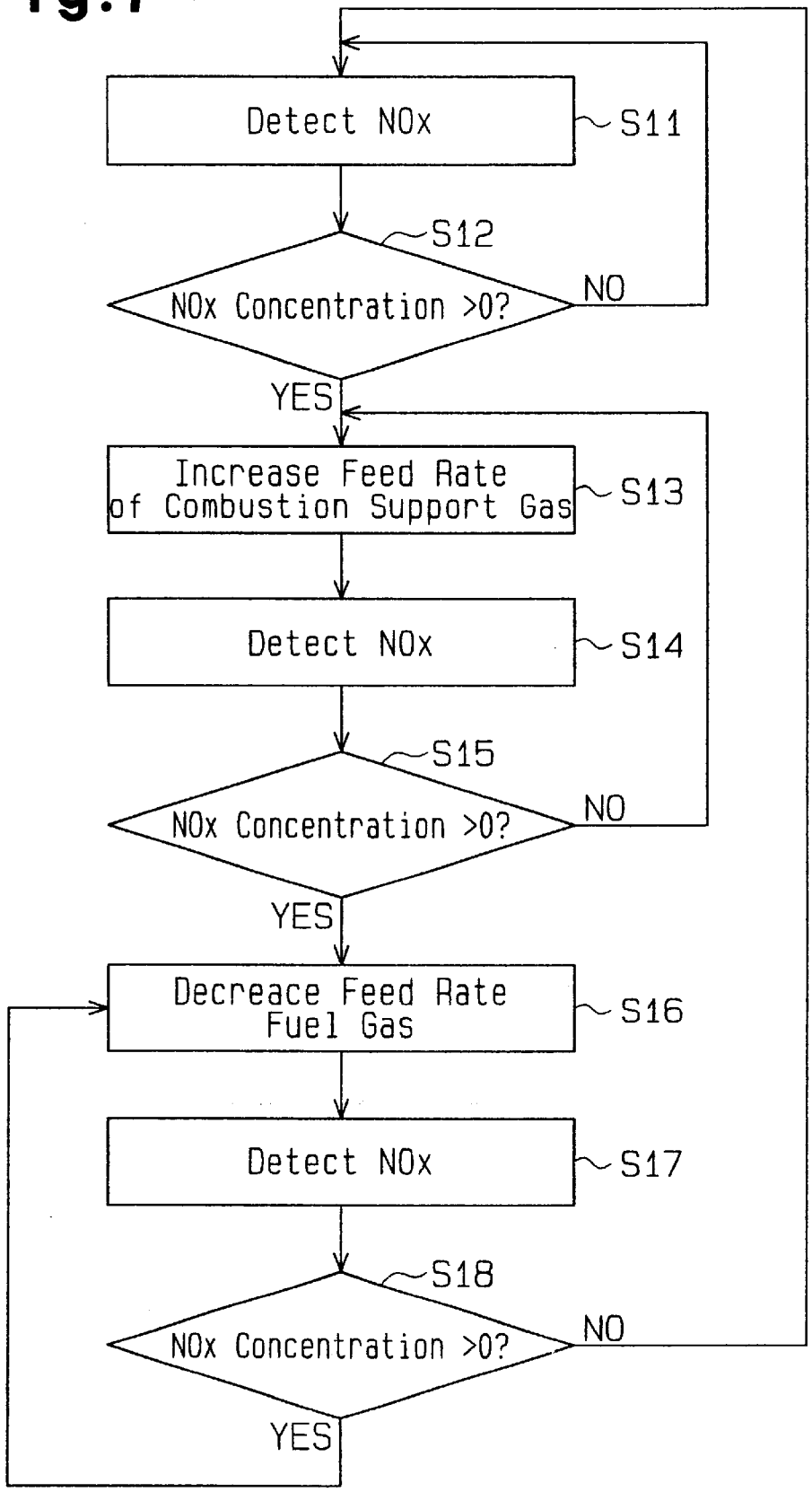
FIG. 7 is a flowchart illustrating the operation of the catalytic combustion heater 70.

FIG. 7 is a flowchart illustrating the operation of the catalytic combustion heater 70.

As illustrated in the flowchart in FIG. 7, the control unit 6 causes the $NO_x$ detector 9 to detect $NO_x$ (step S11). From the $NO_x$ detection signal, which corresponds to the $NO_x$ detected by the $NO_x$ detector 9, the control unit 6 determines if the $NO_x$ concentration is greater than zero (step S12).

When $NO_x$ is detected, the control unit 6 increases the feed rate of the combustion support gas (to the maximum amount here) to make the fuel gas leaner (step S13). This occurs at time b in FIG. 6B. As shown in FIG. 6A, since it is difficult to sustain the flame combustion in a lean gas, the $NO_x$ concentration drops after a certain time passes from time b.

Next, the $NO_x$ concentration is detected again (step S14). The control unit 6 determines whether the $NO_x$ concentration is greater than zero (step S15). When the $NO_x$ concentration is greater than zero, the feed rate of the fuel is reduced (step S16). This occurs at time c in FIG. 6C. Since the flame combustion is difficult to sustain if the feed rate of the fuel decreases, the $NO_x$ concentration further drops after a certain time passes from time c.

Then, the detection of the $NO_x$ concentration is carried out subsequently (step S17). The control unit 6 determines if the $NO_x$ concentration is greater than zero (step S18). When the $NO_x$ concentration is not greater than zero, the routine goes to step S11. That is, steps S11 to S18 are repeated. When the $NO_x$ concentration is greater than zero, the routine goes to step S16. That is, steps S16 to S18 are repeated until the $NO_x$ concentration becomes zero.

According to this embodiment, since the $NO_x$ detector 9 detects $NO_x$, the production of a flame is detected promptly, and abnormal combustion is limited by controlling the feed rate of the combustion support gas or the flammable gas accordingly. This embodiment therefore ensures stable catalytic combustion and prevents the catalyst from deteriorating due to a high temperature. This improves the reliability of the heater. The control method for the feed rates of the flammable gas and the combustion support gas is not limited to the one illustrated in FIG. 6. The flammable gas may be reduced or stopped being fed immediately upon detection of $NO_x$.

The control method of the second embodiment using the $NO_x$ detector 9 can be adapted to a catalytic combustion heater that has a structure in which the advancing direction of the object fluid is opposite to that of the fuel gas. In this case, since the high-temperature object fluid flows on the upstream end of the fuel-gas flow passage 11, where the high-concentration gas is supplied, the fins 51 and the tubes 5 are likely to become hot and a flame is likely to be produced. The provision of the $NO_x$ detector 9 therefore prevents abnormal combustion more effectively. Further, the first embodiment may of course be combined with the constitution of the second embodiment. In this case, prevention of condensation of vapor and prevention of flame combustion are accomplished at the same time, thus further improving the catalytic performance.

Third Embodiment

Figure 8A:
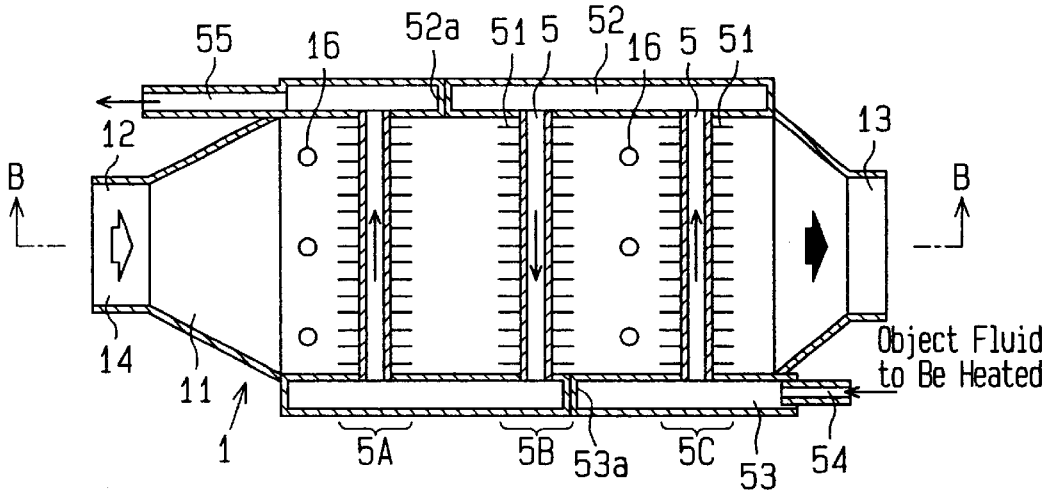
FIG. 8A is a diagram showing a catalyst-carrying heat exchanger 1 in a catalytic combustion heater 80 according to a third embodiment.
Figure 8B:
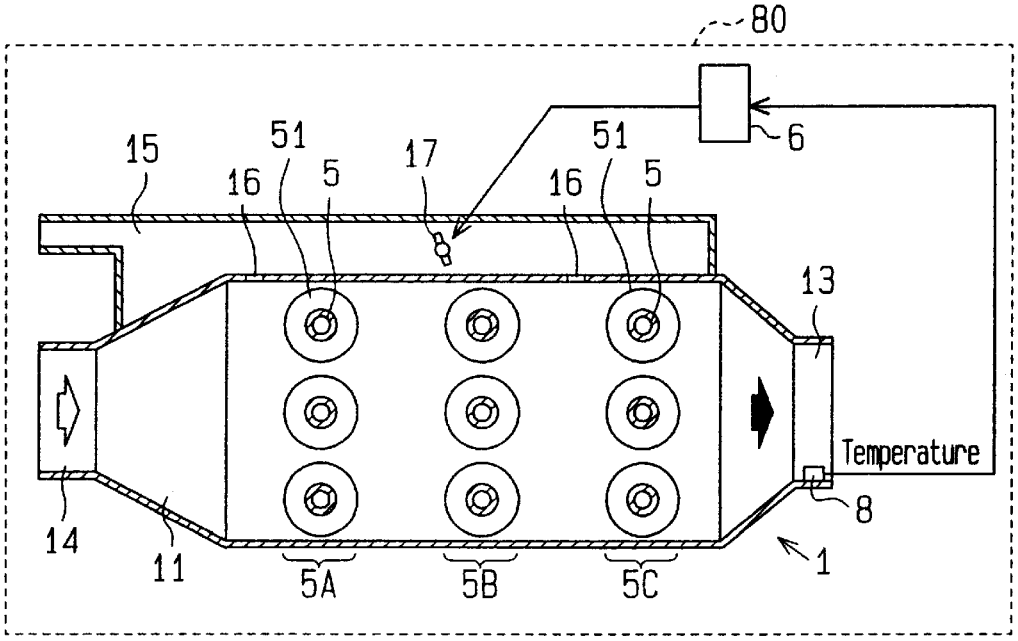
FIG. 8B is a diagram depicting a cross section when the catalyst-carrying heat exchanger 1 shown in FIG. 8A is cut along the line B—B.

FIG. 8A is a diagram showing the catalyst-carrying heat exchanger 1 of a catalytic combustion heater 80 according to the third embodiment. FIG. 8B is a diagram depicting a cross section when the catalyst-carrying heat exchanger 1 shown in FIG. 8A is cut along the line B—B.

The catalytic combustion heater 80 comprises the catalyst-carrying heat exchanger 1, the control unit 6, the temperature detector 8 and a restrictor 17. The basic construction of this embodiment is substantially the same as that of the above-described first embodiment, and the following will mainly describe the differences.

In this embodiment, the fuel-gas feeding section 2, which mixes the flammable gas with the combustion support gas, is not provided, and a combustion support-gas feed port 14 is connected to the combustion support-gas feeding unit (not shown) at the left end of the fuel-gas flow passage 11.

As shown in FIG. 8B, the flammable gas is distributed into the fuel-gas flow passage 11 via a plurality of fuel feed ports 16 from an flammable-gas feeding section 15, which is provided to the side of the catalyst-carrying heat exchanger 1, and flows toward the exhaust-gas port 13 while being mixed with the combustion support gas. According to this embodiment, the fuel gas flows in the fuel-gas flow passage 11 in a direction opposite to the flow direction of the object fluid (the gas flows from left to right in the figure).

Three rows 5A to 5C of tubes 5 are formed in the fuel-gas flow passage 11. Fuel feed ports 16, the number of which is predetermined, are formed on the upstream side of the most upstream tube row 5A and on the upstream side of the most downstream tube row 5C (FIG. 8A). The flammable-gas feeding unit (not shown) is connected to the left end of the flammable-gas feeding section 15. The restrictor 17 is a valve member located in the flammable-gas feeding section 15. As the control unit 6 changes the valve position, the flow rate of the flammable gas supplied to the most downstream tube row 5C via the downstream fuel feed ports 16 is adjusted. The valve angle of the restrictor 17 is controlled by the control unit 6 based on the temperature of the combustion exhaust gas, which is detected by the temperature detector 8 in the exhaust-gas port 13.

The control method for the flow rate of the flammable gas in this embodiment will now be described.

Figure 9A:
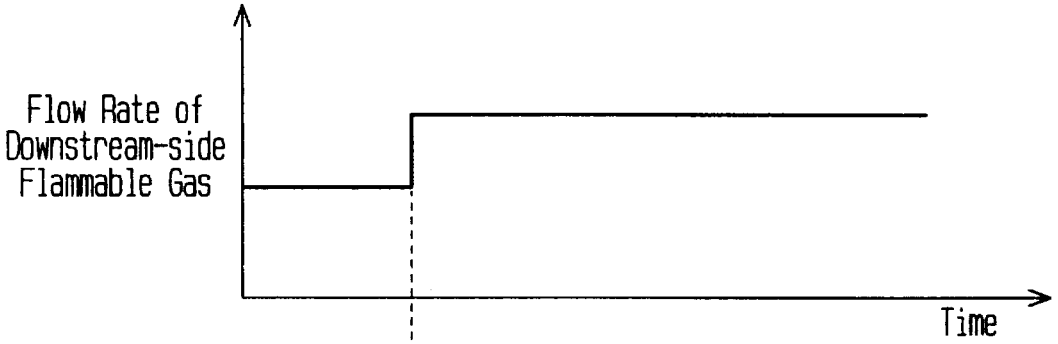
FIG. 9A is a diagram showing the relationship between the flow rate of an flammable gas at a downstream side and time.
Figure 9B:
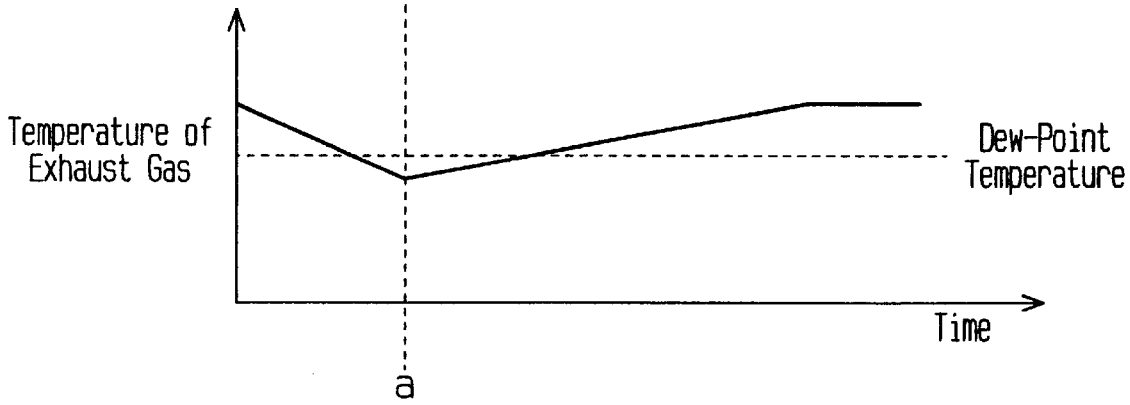
FIG. 9B is a diagram showing the relationship between the temperature of an exhaust gas and time.

FIG. 9A is a diagram showing the relationship between the flow rate of the flammable gas at the downstream side and time, and FIG. 9B is a diagram showing the relationship between the temperature of the exhaust gas and time. In the first embodiment, when the temperature of the combustion exhaust gas detected by the temperature detector 8 becomes lower than the dew-point temperature (time a in FIG. 3B), the feed rate of the combustion support gas is increased to raise the temperature of the exhaust gas. In this embodiment, when the temperature of the combustion exhaust gas detected by the temperature detector 8 becomes lower than the dew-point temperature (time a in FIG. 9B), the amount of the flammable gas supplied to the downstream end of the fuel-gas flow passage 11 is increased to raise the temperature of the exhaust gas.

Figure 10:
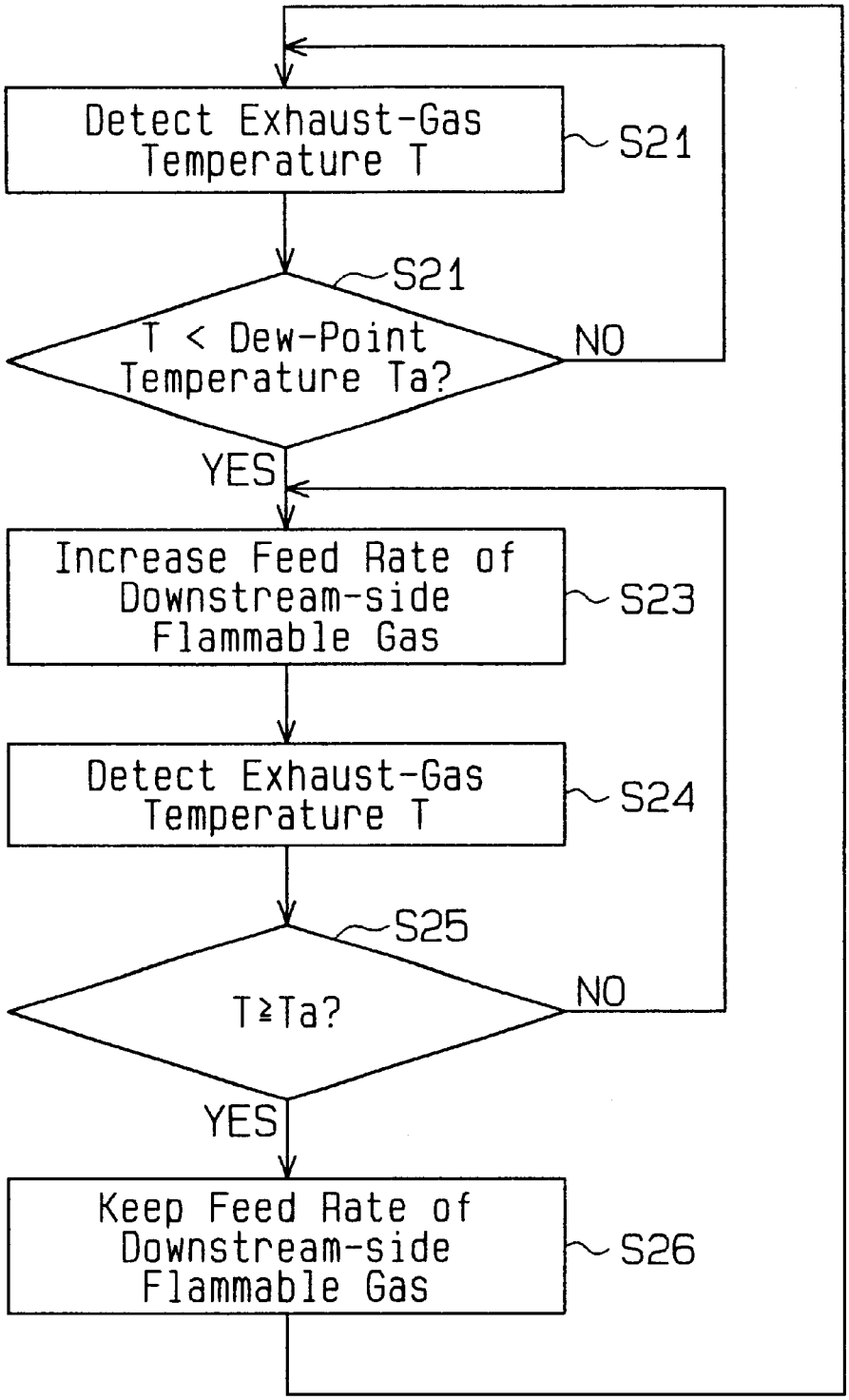
FIG. 10 is a flowchart illustrating the operation of the catalytic combustion heater 80.

FIG. 10 is a flowchart illustrating the operation of the catalytic combustion heater 80.

The temperature detector 8 detects the temperature of the combustion exhaust gas (step S21). The control unit 6 determines if the temperature T is lower than the dew-point temperature Ta, which is determined by the composition of the fuel gas (the dew-point temperature is calculated based on the amount of vapor produced by the combustion of the flammable gas) (step S22).

When $T<Ta$ is met in step S22, the control unit 6 outputs a control signal to the restrictor 17 to increase the feed rate of the flammable gas toward the most downstream tube row 5C by a predetermined amount by increasing the angle of the valve (step S23). This increases the oxidation reaction in the most downstream tube row 5C, which increases the amount of the heat generated on the surfaces of the fins 51. When $T<Ta$ is not met in step S22, the routine goes to step S21.

The temperature detector 8 detects the temperature of the combustion exhaust gas (step S24). When $T \geqq Ta$ is not met in step S25, the routine goes to step S23. Since the operation of increasing the feed rate of the flammable gas of the downstream end in step S23 is repeated, the temperature of the surfaces of the fins 51 on the downstream end of the fuel-gas flow passage 11 can be raised to or above the dew-point temperature Ta (e.g., 73° C. for hydrogen) during combustion of the fuel gas.

When $T \geqq Ta$ is met in step S25, the control unit 6 outputs a control signal to the restrictor 17 to maintain the current feed rate of the flammable gas (step S26).

If the surface temperature of the downstream-side fins 51 becomes higher than needed, the difference between the surface temperature of the catalyst and the temperature of the fuel gas increases, thus raising the temperature of the combustion exhaust gas. This reduces the overall heat exchanging efficiency of the catalytic combustion heater 80. To avoid this, the control unit 6 controls the feed rate of the flammable gas such that the temperature T detected by the temperature detector 8 becomes close to the dew-point temperature Ta.

According to this embodiment, as described above, the problem of a reduction in the temperature of the combustion exhaust gas that occurs when the advancing direction of the object fluid is opposite to the flow direction of the fuel gas can be overcome by controlling the feed rate of the flammable gas supplied to the downstream end of the fuel-gas flow passage 11 by the control unit 6. This prevents the catalyst from becoming inactive due to condensation of vapor, which would cause unburned gas to be discharged. This embodiment is therefore reliable and results in efficient heat transfer.

Although three fuel feed ports 16 are provided upstream of the upstream row 5A and upstream of the most downstream row 5C in this embodiment, the number of the fuel feed ports 16 and the locations thereof are not so limited, but can be determined as needed such that the necessary amount of flammable gas can be separately supplied to the individual rows.

Fourth Embodiment

Figure 11A:
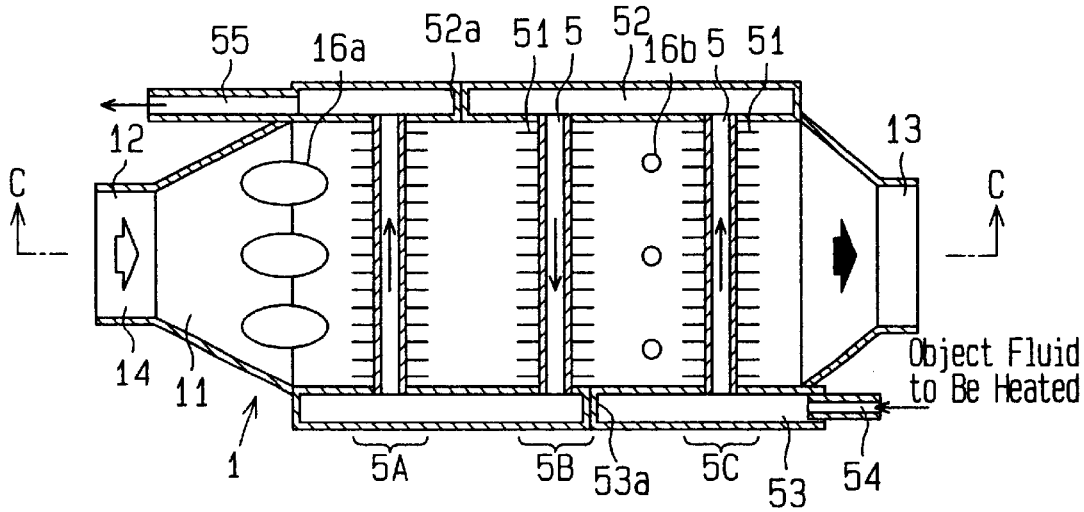
FIG. 11A is a diagram showing a catalyst-carrying heat exchanger 1 which is a catalytic combustion heater according to a fourth embodiment.
Figure 11B:
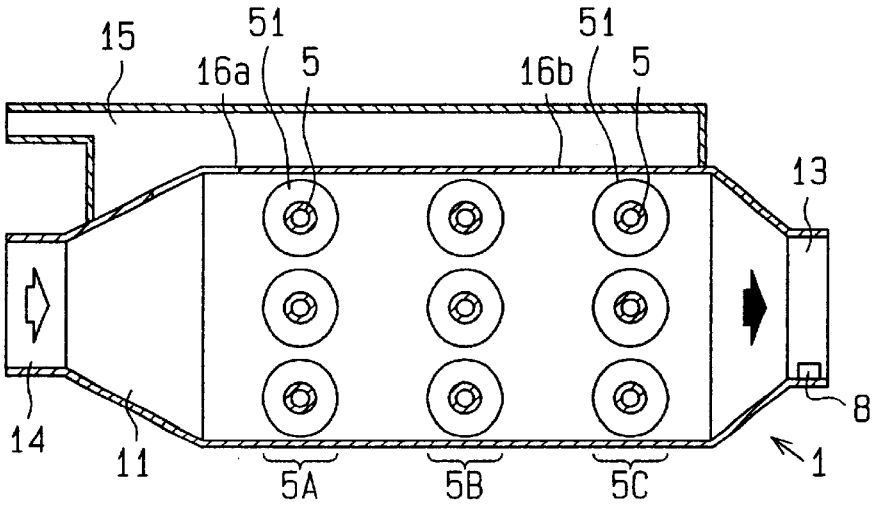
FIG. 11B is a diagram depicting a cross section when the catalyst-carrying heat exchanger 1 shown in FIG. 11A is cut along the line C—C.

FIG. 11A is a diagram showing a catalyst-carrying heat exchanger 1, which is a catalytic combustion heater according to the fourth embodiment. FIG. 11B is a diagram depicting a cross section when the catalyst-carrying heat exchanger 1 shown in FIG. 11A is cut along the line C—C.

The catalytic combustion heater according to the fourth embodiment includes the catalyst-carrying heat exchanger 1. The construction of this embodiment is basically the same as the above-described third embodiment except that the control unit, the temperature detector and the restrictor are removed.

In this embodiment, for example, the restrictor of the third embodiment is not provided in the flammable-gas feeding section 15. The passage resistances of flammable-gas feed ports 16*a* which become the flammable-gas feed passage toward the upstream side of the fuel-gas flow passage 11 and flammable-gas feed ports 16*b* which become the flammable-gas feed passage toward the downstream side become specific values, and necessary amounts of flammable gas are supplied to them respectively.

Specifically, the size of each of the upstream flammable-gas feed ports 16*a* is larger than that of the downstream flammable-gas feed ports 16*b* to feed a sufficient amount of flammable gas to the upstream end, and the total cross-sectional area of the downstream flammable-gas feed ports 16*b* is adjusted to be large enough to deliver enough flammable gas for the surfaces of the fins 51 of the most downstream tube row 5C to avoid becoming wet when the heater provides the minimum output.

With the above-described construction, at the minimum output level of the catalytic combustion heater, the passage resistances are adjusted to feed a predetermined amount or more flammable gas to the most downstream tube row 5C via the flammable-gas feed ports 16*b*. It is therefore possible to keep the surfaces of the fins 51 at or higher than the dew-point temperature due to the heat generated by the oxidation reaction and to prevent vapor from condensing.

When the output is high, the flow rate in the flammable-gas feeding section 15 increases so that more fuel is supplied to the most upstream tube row 5A from the upstream flammable-gas feed ports 16*a*. The heat that is not transferred to the upstream tubes 5 is carried by the combustion gas and is transferred to the downstream tubes 5, which increases the temperature of the downstream tube row 5C. This prevents the surface of the catalyst from becoming wet.

As apparent from the above, this embodiment maintains the temperature of the surfaces of the downstream tubes 5 at or above the dew-point temperature, without detecting the temperature or adjusting the feed rate of the flammable gas. It is therefore possible to reduce the number of parts, simplify the control, reduce the cost and improve the efficiency of the catalytic combustion heater.

Fifth Embodiment

Figure 12A:
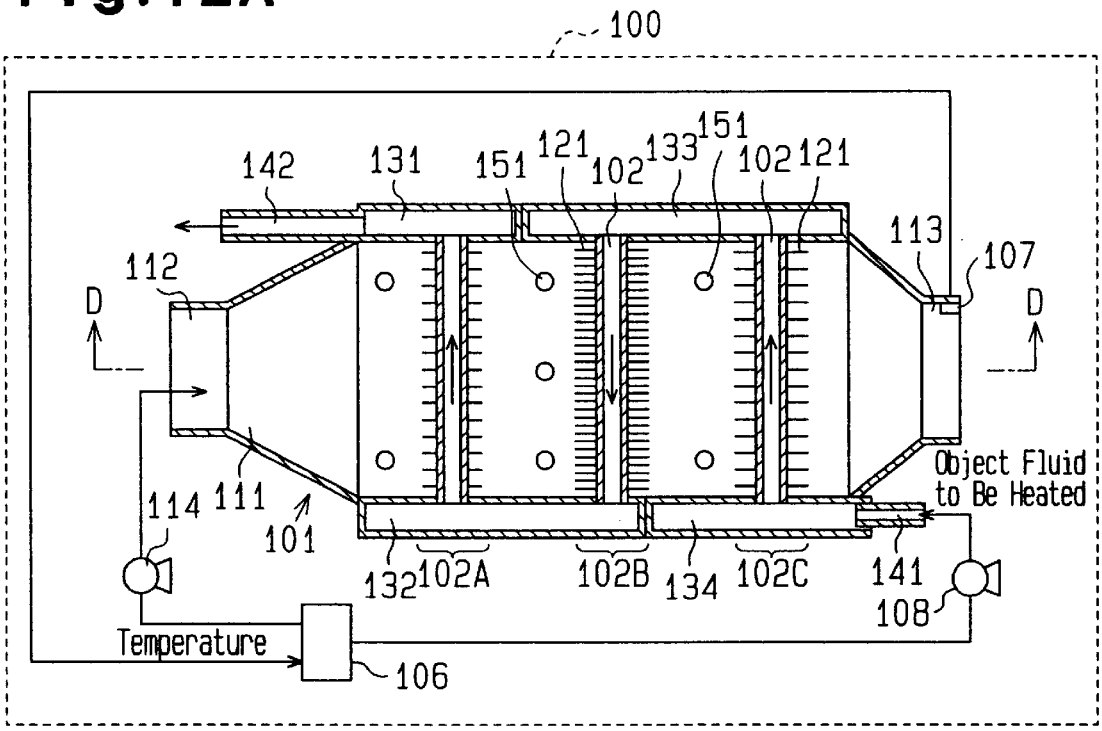
FIG. 12A is a diagram showing a catalytic combustion heater 100 according to a fifth embodiment.
Figure 12B:
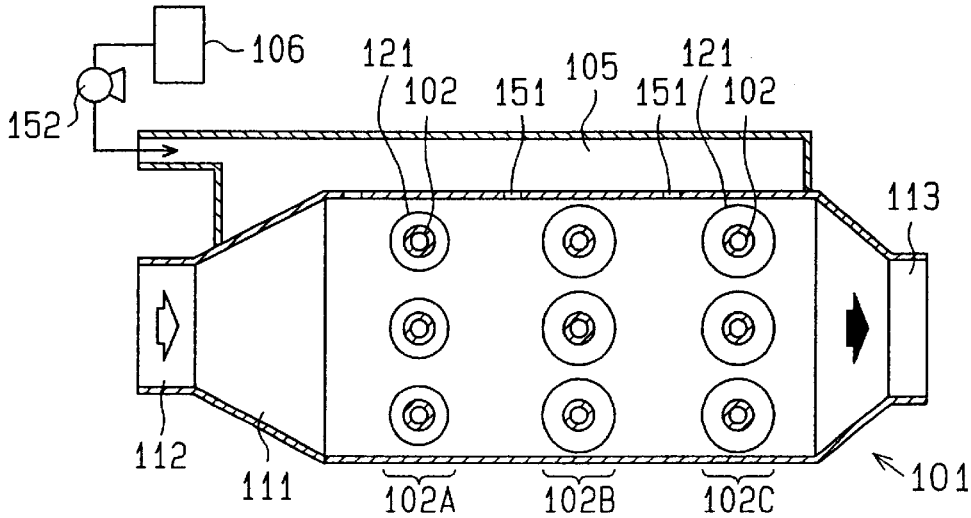
FIG. 12B is a diagram depicting a cross section when a catalyst-carrying heat exchanger 101 shown in FIG. 12A is cut along the line D—D.

FIG. 12A is a diagram showing a catalytic combustion heater 100 according to the fifth embodiment. The catalytic combustion heater 100 has a catalyst-carrying heat exchanger 101, a control unit 106 and a temperature detector 107. FIG. 12B is a diagram depicting a cross section when the catalyst-carrying heat exchanger 101 shown in FIG. 12A is cut along the line D—D.

The interior of the cylindrical catalyst-carrying heat exchanger 101, both ends of which are open, is the passage 111 for the fuel gas. The fuel gas is comprised of the mixture of flammable gas and combustion support gas. Hydrogen, methanol or the like, for example, is used as the flammable gas, and air, for example, is used as the combustion support gas.

The catalyst-carrying heat exchanger 101 has a combustion support-gas feed passage 112 provided at the left end in FIGS. 12A and 12B, and an exhaust port 113 provided at the right end in FIGS. 12A and 12B. The fuel gas flows in the fuel-gas flow passage 111 from left to right in FIGS. 12A and 12B.

As shown in FIG. 12B, an flammable-gas feeding section 105 for distributing the fuel is formed at the side of the catalyst-carrying heat exchanger 101.

In the fuel-gas flow passage 111, multiple tubes 102, in which the object fluid flows, extend perpendicular to the flow of the fuel gas (the vertical direction in FIG. 12A) and are arranged in rows parallel to one another in the flow path of the fuel gas (FIG. 12B).

In this example, three rows 102A to 102C of tubes 102 are formed. Multiple annular fins 121 are integrally connected to the outer surface of each tube 102 by brazing or the like. An oxidation catalyst such as platinum or palladium is carried on the outer surfaces of the fins 121, with a porous substance such as alumina as a carrier.

The flammable-gas feeding section 105 has multiple fuel feed ports 151, which are formed in each of the rows 102A to 102C of the tubes 102, for distributing the flammable gas, the quantity of which corresponds to the state of the object fluid that flows inside the tubes 102. The multiple flammable-gas feed ports 151 penetrate the side wall of the catalyst-carrying heat exchanger 101 and are open to the interior of the fuel-gas flow passage 111 (FIG. 12B).

Fuel feed ports 151, the number of which is predetermined, are formed on the upstream side of the rows 102A to 102C of tubes 102 (FIG. 12A). The necessary amounts of the flammable gas for the respective rows are separately supplied to the rows.

The number of the flammable-gas feed ports 151 corresponding to each of the rows 102A to 102C is determined to feed the necessary amount of flammable gas in accordance with the state of the object fluid in each layer. Since the object fluid has a high heat transfer coefficient when it is boiling and needs a lot of heat to become vapor from a liquid, more flammable-gas feed ports 151 are formed upstream of the intermediate row 102B, in which the object fluid is boiling, than the other rows.

An flammable-gas feeding unit 152 is connected to one end (the left end in FIG. 12B) of the flammable-gas feeding section 105. The temperature detector 107 is located in the exhaust port 113 of the fuel-gas flow passage 111. The flow-rate control unit 106, which controls the flow rate based on the temperature of the combustion exhaust gas detected by the temperature detector 107, controls the flow rate of the flammable gas supplied to the flammable-gas feeding section 105. The flow-rate control unit 106 also controls the flow rate of the combustion support gas supplied to the combustion support-gas feed passage 112 by a combustion support-gas feeding unit 114.

The tubes 102 that form the upstream row 102A are coupled together by fluid reservoirs 131 and 132 provided at both ends (FIG. 12A).

Likewise, the intermediate row 102B is coupled to fluid reservoirs 132 and 133, the downstream row 102C is coupled to fluid reservoirs 133 and 134, an inlet pipe 141 for the object fluid is coupled to the fluid reservoir 134 and an inlet pipe 142 is coupled to the fluid reservoir 131. This forms the passage for the object fluid, which alternates direction in the fuel-gas flow passage 111 toward the upstream end from the downstream end, as indicated by the arrows in FIG. 12A.

Water, for example, is the object fluid, and it is heated to a high temperature by the oxidation reaction heat of the fuel gas while flowing through this passage, and the water is vaporized by boiling. Here, the flow rate, the amount of heat generated and so forth are controlled so that, for example, the object fluid is liquid in the downstream row 102C, boils in the intermediate row 102B and is vapor in the upstream row 102A. The object fluid is fed into the inlet pipe 141 by the aforementioned object fluid feeding unit 108, and its flow rate is controlled by the flow-rate control unit 106.

The path of the fins 121 on the outer surfaces of the tubes 102 is smaller in the intermediate row 102B, where the object fluid flowing inside is boiling and requires a large amount of heat, than in the other rows (FIG. 12A), so that the heat generating area of the intermediate row 102B is relatively large.

In the upstream row 102A, where the high-temperature object fluid flows, the size of the tubes 102 is small to prevent overheating of the fins 121 and tubes 102. Although the size and the number of the tubes 102 of each row are identical here, they can be changed in accordance with the amount of heat needed for the object fluid in the tubes 102.

In the above-described construction, the combustion support gas is fed into the fuel-gas flow passage 111 from the combustion support-gas feed passage 112, is mixed with the flammable gas supplied by the flammable-gas feeding section 105 via the multiple flammable-gas feed ports 151 and is fed to the individual row of tubes 102. Then, it causes an oxidation reaction with the catalyst on the fins 121 and flows from left to right in FIGS. 12A and 12B toward the exhaust port 113 while undergoing catalytic combustion. The flow rates of the combustion support gas and flammable gas are controlled by the flow-rate control unit 106, and the heater is activated quickly by controlling, particularly, the flow rate of the flammable gas based on the temperature of the combustion exhaust gas.

The control method for the flow rates of the combustion support gas and the flammable gas by the flow-rate control unit 106 will now be described with reference to FIGS. 13A to 13D and FIG. 14.

Figure 13A:
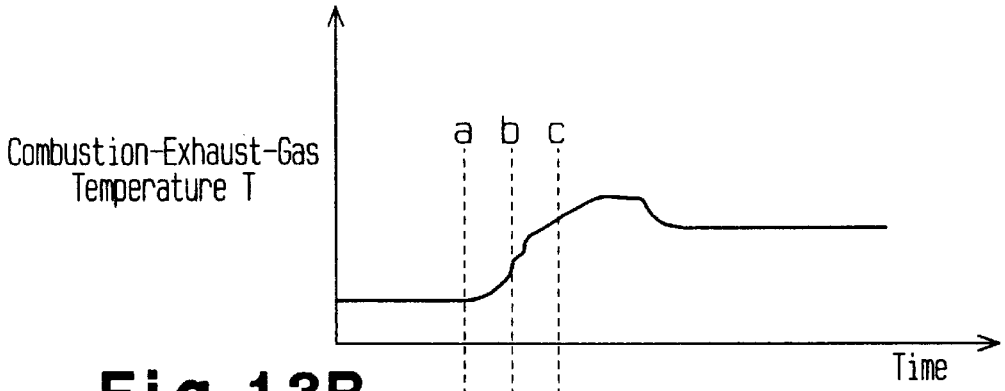
FIG. 13A is a diagram showing the relationship between the temperature of a combustion exhaust gas and time.
Figure 13B:
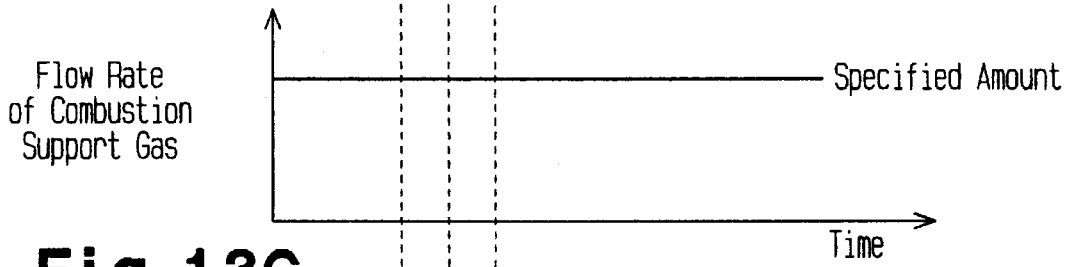
FIG. 13B is a diagram showing the relationship between the flow rate of a combustion support gas and time.
Figure 13C:
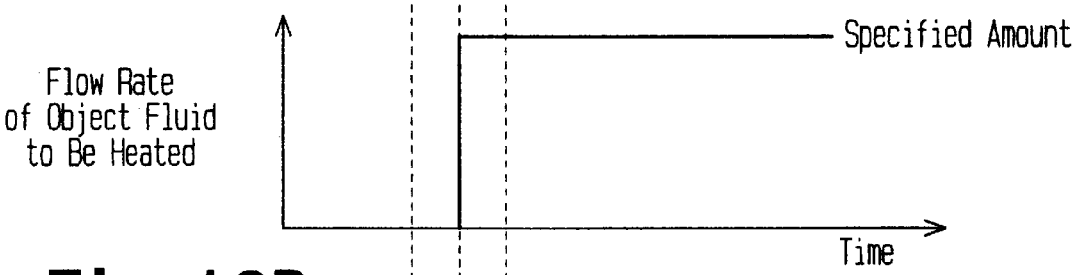
FIG. 13C is a diagram showing the relationship between the flow rate of an object fluid to be heated and time.
Figure 13D:
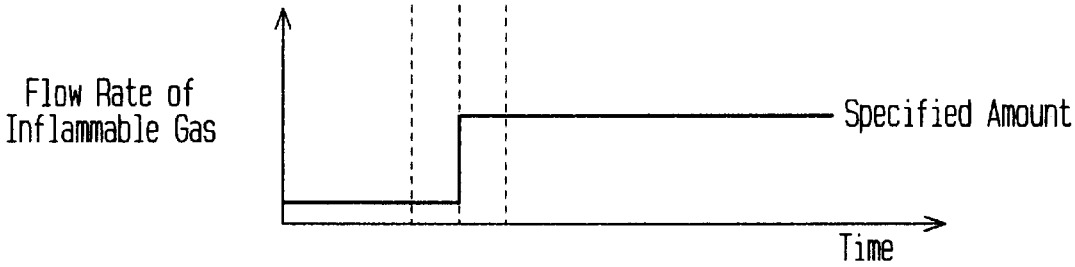
FIG. 13D is a diagram showing the relationship between the flow rate of an flammable gas and time.
Figure 14:
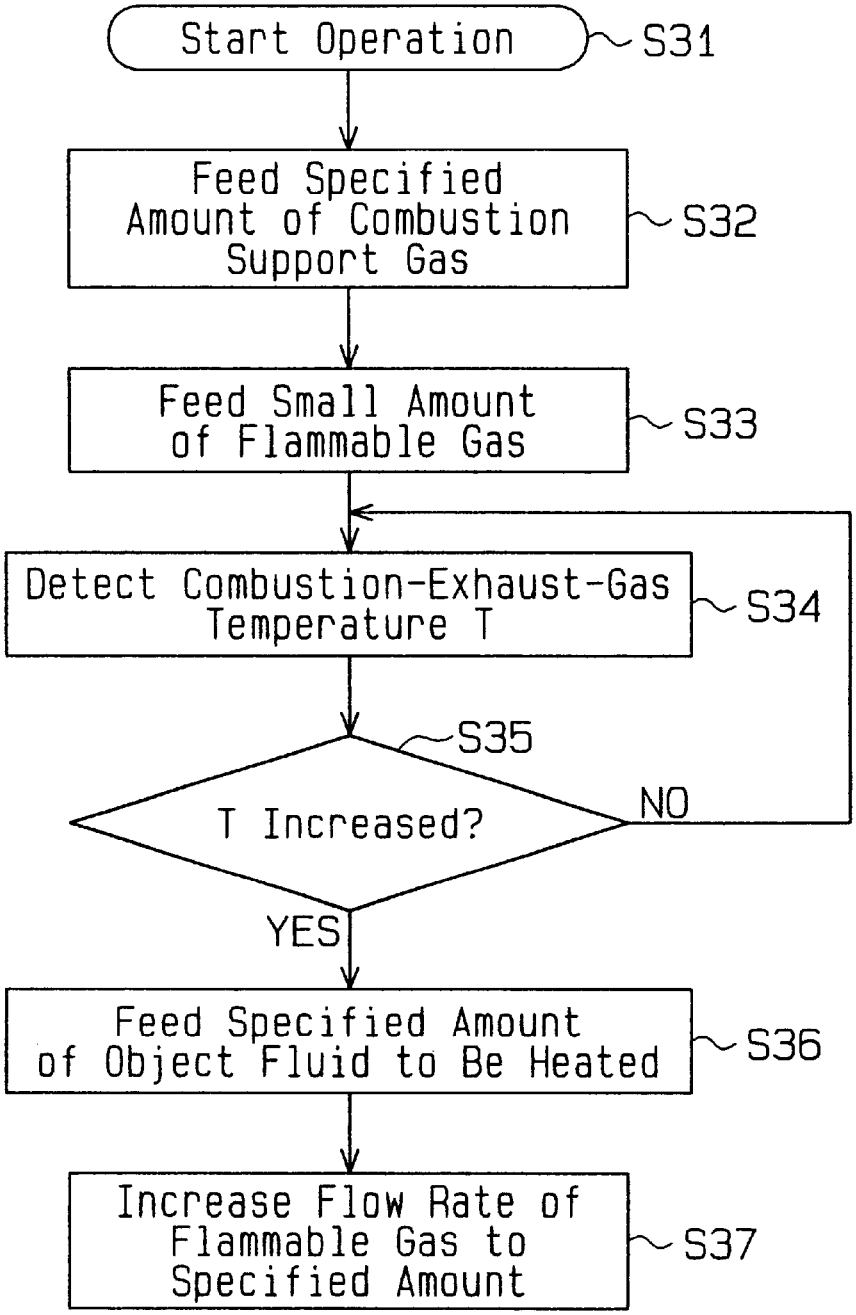
FIG. 14 is a flowchart illustrating the operation of the catalytic combustion heater 100.

FIG. 13A is a diagram showing the relationship between the temperature of the combustion exhaust gas and time, FIG. 13B is a diagram showing the relationship between the flow rate of the combustion support gas and time, FIG. 13C is a diagram showing the relationship between the flow rate of the object fluid and time, and FIG. 13D is a diagram showing the relationship between the flow rate of the flammable gas and time. FIG. 14 is a flowchart illustrating the operation of the catalytic combustion heater 100.

In this embodiment, the flow-rate control unit 106 reduces the flow rate of the flammable gas until the temperature of the combustion exhaust gas detected by the temperature detector 107 exceeds a predetermined temperature and increases the flow rate of the flammable gas to a specified amount when the temperature of the combustion exhaust gas exceeds the predetermined temperature.

Specifically, as shown in FIG. 14, the catalytic combustion heater 100 is activated (step S31). The flow-rate control unit 106 controls the heater to feed only a specified amount of combustion support gas (step S32) and, at the same time, feeds the flammable gas (step S33).

At this time, it is desirable that the flow-rate control unit 106 controls the feed rate of the flammable gas such that the feed rate is low compared to the flow rate of the flammable gas, and specifically, the control unit 106 sets the ratio of the flammable gas flow rate to the combustion support gas flow rate to less than 4%, preferably about 1%. When the ratio of the flammable gas to the combustion support gas is about 1%, even if unburned gas, which has not reacted at the upstream end of the fuel-gas flow passage 111, rapidly reacts at the downstream end, a fire would not occur because the ratio is sufficiently below the flame limit of 4%.

This embodiment has a structure where multiple flammable-gas feed ports 151 are provided to separately feed the flammable gas, and a given rate of flammable gas is fed to the downstream end. When the flow rate of the flammable gas is sufficiently small, the influence of the kinetic energy of the flammable gas is very small, so that the ratio of the flammable gas that flows out of the flammable-gas feed ports 151 at the upstream end of the fuel-gas flow passage 111 becomes relatively high. Therefore, the flammable gas flows to the downstream end from the upstream end while gradually reacting, so that extreme blow-by of the flammable gas does not occur.

On the downstream end of the fuel-gas flow passage 111, the temperature detector 107 detects the combustion-exhaust-gas temperature T near the exhaust port 113 whenever necessary (step S34). The flow-rate control unit 106 determines if the detected combustion-exhaust-gas temperature T is increasing (step S35). Specifically, it is determined in step S35 whether or not the detected combustion-exhaust-gas temperature T has exceeded a combustion-exhaust-gas temperature Tb. When the combustion-exhaust-gas temperature T has risen, the routine goes to step S36. When the combustion-exhaust-gas temperature T has not risen, the routine goes to step S34. In other words, this is repeated until a rise in the detected combustion-exhaust-gas temperature T is confirmed.

For example, as shown in FIG. 13A, the combustion-exhaust-gas temperature T starts rising at time a and rapidly rises at time b. Then, it is determined if the detected combustion-exhaust-gas temperature T has exceeded the combustion-exhaust-gas temperature Tb. When the combustion-exhaust-gas temperature T has exceeded the combustion-exhaust-gas temperature Tb, i.e., when it is determined in step S35 that the combustion-exhaust-gas temperature T is rising, the flow-rate control unit 106 controls the feed rate of the object fluid to be the specified rate (step S36), and, at the same time, increases the flow rate of the flammable gas to the specified amount (step S37).

When the amount of the flammable gas is small, 1%, with respect to the amount of the combustion support gas, a rise in the temperature of the combustion exhaust gas cannot be confirmed clearly unless the flammable gas is completely oxidized. That is, if the temperature of the combustion exhaust gas clearly starts rising, it is possible that the supplied flammable gas has been oxidized completely and part of the catalyst has reached the activation temperature.

In the catalytic combustion, when the catalyst temperature rises to approximately 60% of the temperature for completely oxidizing flammable gas, the quantity of which corresponds to the reaction area, the reaction becomes active thereafter in accordance with an increase in the fuel. As shown in FIGS. 13C to 13D, therefore, the flow rates of the object fluid and the flammable gas are increased to the specified amounts at time b, and, at the same time, the catalytic combustion is accelerated to raise the temperature T of the combustion exhaust gas further. After time c, as shown in FIG. 13A, the temperature rise subsides, the combustion is stabilized, the temperature T of the combustion exhaust gas becomes substantially constant.

As apparent from the above, the above-described structure can promptly make the entire catalyst-carrying heat exchanger active and can start the heater in a short period of time, while avoiding the risk of a fire. Further, the provision of the multiple flammable-gas feed ports 151 to separately feed the flammable gas of the catalyst-carrying heat exchanger so that the quantity of flammable gas fed to each section corresponds to the state of the object fluid. Even when an flammable gas that has a relatively fast reaction speed, such as hydrogen, is used, the fins 121 and the tubes 102 are not excessively heated by an increase in the catalytic reaction on the upstream end of the fuel-gas flow passage 111, which reduces the likelihood of a fire or the like. Further, highly efficient heat transfer is achieved by supplying the necessary amounts of flammable gas to the individual sections.

Sixth Embodiment

Figure 15A:
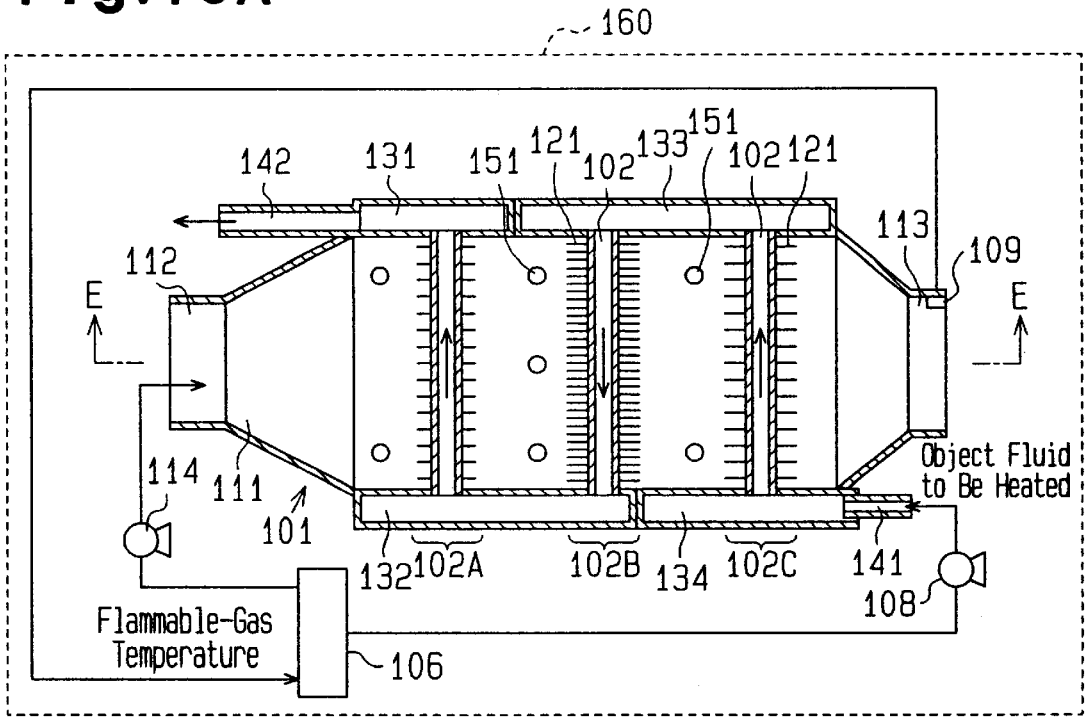
FIG. 15A is a diagram showing a catalyst-carrying heat exchanger 1, which is a catalytic combustion heater 160 according to a sixth embodiment.
Figure 15B:
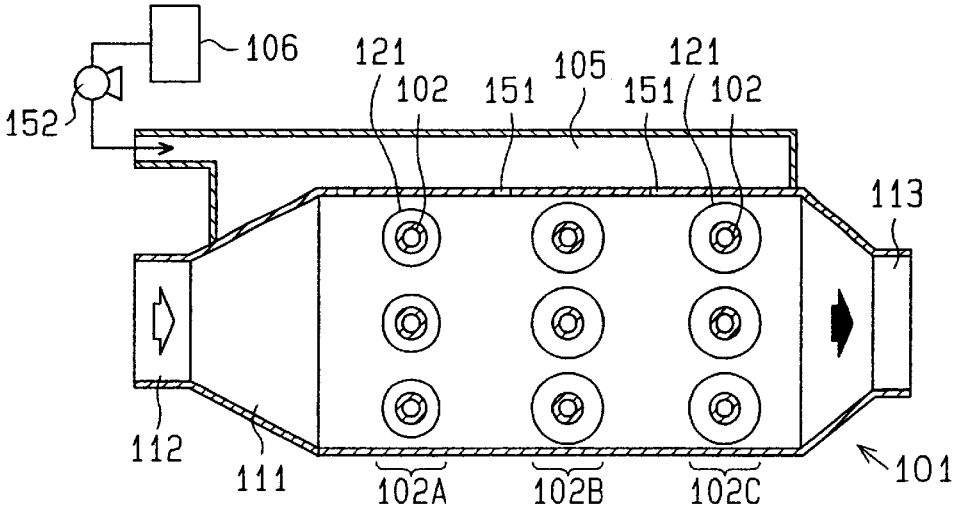
FIG. 15B is a diagram depicting a cross section when the catalyst-carrying heat exchanger 1 shown in FIG. 15A is cut along the line E—E.

FIG. 15A is a diagram showing a catalyst-carrying heat exchanger 101, which is a catalytic combustion heater 160, according to the sixth embodiment. FIG. 15B is a diagram depicting a cross section when the catalyst-carrying heat exchanger 101 shown in FIG. 15A is cut along the line E—E.

In this embodiment, in place of the temperature detector 107 of the fifth embodiment, an flammable-gas concentration detector 109 is located in the exhaust port 113 of the fuel-gas flow passage 111 in the catalyst-carrying heat exchanger 101. This construction is substantially the same as that of the fifth embodiment. The flammable-gas concentration detector 109 detects the concentration of the flammable gas in the combustion exhaust gas in the vicinity of the exhaust port 113 and the flow-rate control unit 106, or the flow-rate control means, as controls the flow rate of the flammable gas supplied to the flammable-gas feeding section 105 based on the detection result.

The control method for the flow rates of the combustion support gas and the flammable gas by the above flow-rate control unit 106 will now be described with reference to FIGS. 16A to 16D and FIG. 17.

Figure 16A:
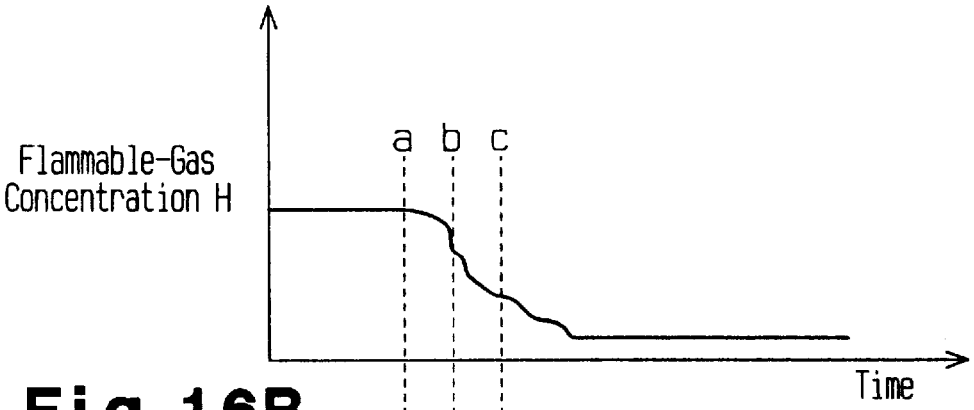
FIG. 16A is a diagram showing the relationship between the concentration of an flammable gas and time.
Figure 16B:
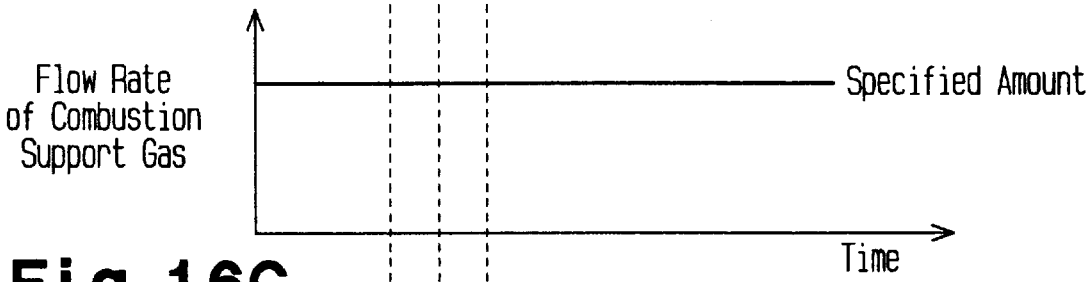
FIG. 16B is a diagram showing the relationship between the flow rate of a combustion support gas and time.
Figure 16C:
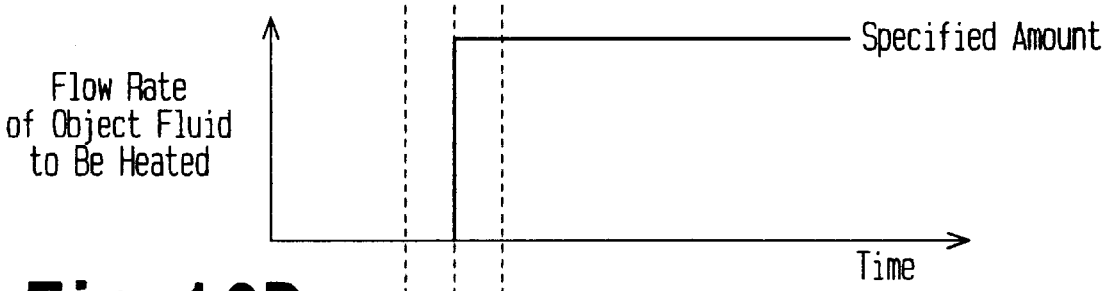
FIG. 16C is a diagram showing the relationship between the flow rate of an object fluid to be heated and time.
Figure 16D:
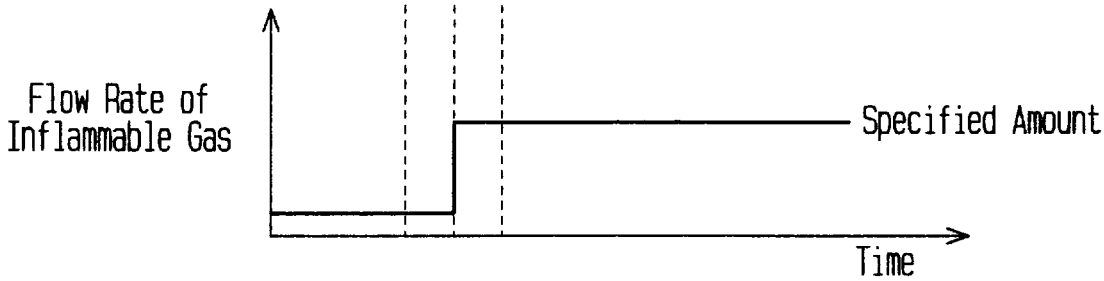
FIG. 16D is a diagram showing the relationship between the flow rate of the flammable gas and time.
Figure 17:
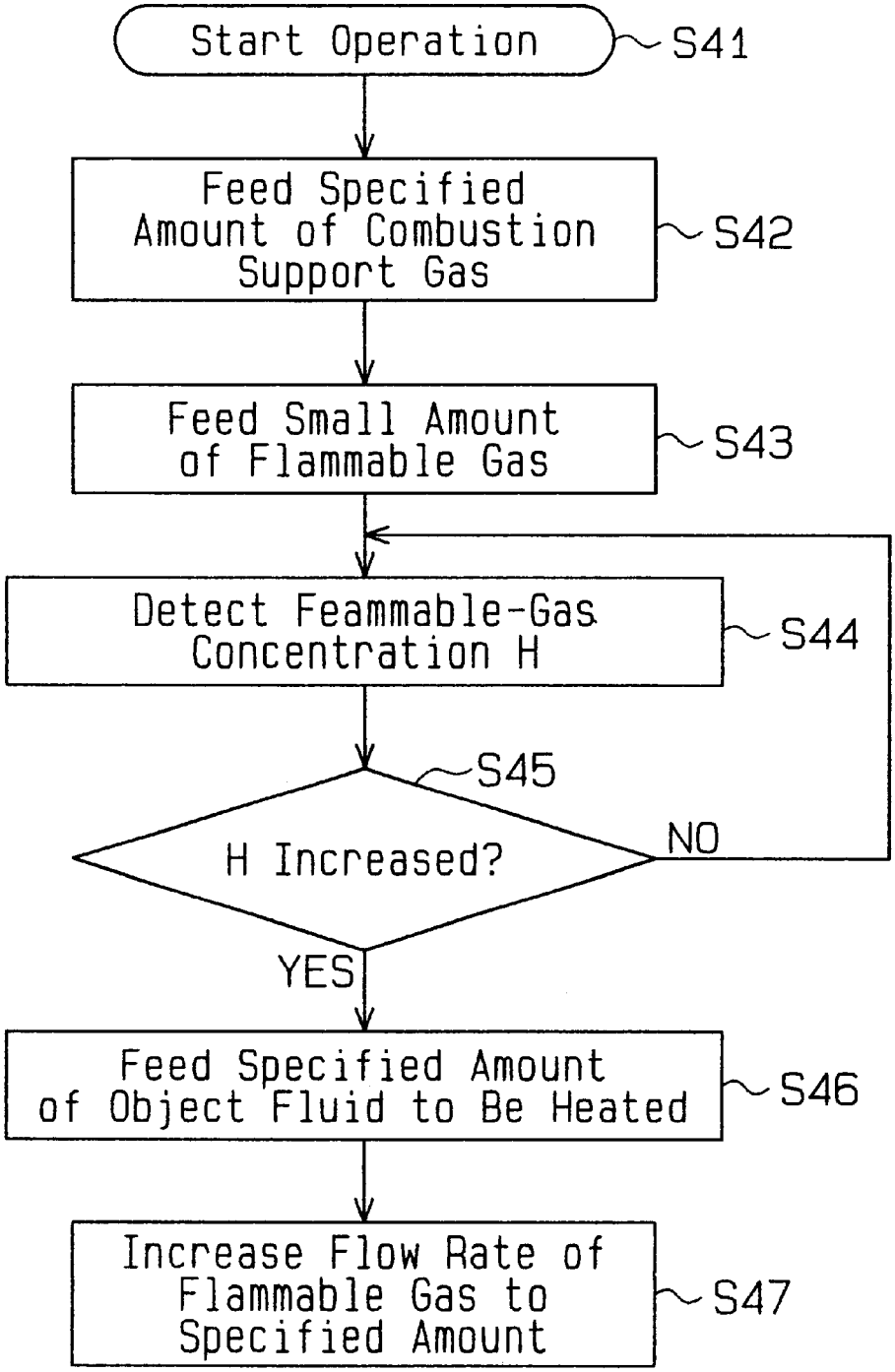
FIG. 17 is a flowchart illustrating the operation of the catalytic combustion heater 160.

FIG. 16A is a diagram showing the relationship between the concentration of the flammable gas and time, FIG. 16B is a diagram showing the relationship between the flow rate of the combustion support gas and time, FIG. 16C is a diagram showing the relationship between the flow rate of the object fluid and time and FIG. 16D is a diagram showing the relationship between the flow rate of the flammable gas and time. FIG. 17 is a flowchart illustrating the operation of the catalytic combustion heater 160.

In this embodiment, the flow-rate control unit 106 controls the flow rate of the flammable gas to be very low until the concentration of the flammable gas detected by the flammable-gas concentration detector 109 is below a predetermined concentration, and the control unit 106 increases the flow rate of the flammable gas to a specified amount when the concentration of the flammable gas is below the predetermined concentration.

Specifically, the catalytic combustion heater 160 is activated (step S41). The flow-rate control unit 106 controls the feed rate of the combustion support gas so that a specified amount of combustion support gas (step S42) is fed and, at the same time, the control unit 106 feeds the flammable gas in an amount that is about 1% of the combustion support gas (step S43).

On the downstream end of the fuel-gas flow passage 111, the flammable-gas concentration detector 109 detects the concentration H of the flammable gas near the exhaust port 113 (step S44). The flow-rate control unit 106 determines if the flammable-gas concentration H is decreasing (step S45). When the flammable-gas concentration H is decreasing, the routine goes to step S46. When the flammable-gas concentration H is not falling, the routine goes to step S44. In other words, this is repeated until the flammable-gas concentration H drops abruptly.

For example, in FIG. 16A, the flammable-gas concentration H starts falling at time a and abruptly drops at time b. It is determined whether the detected flammable-gas concentration H has fallen below a predetermined flammable-gas concentration.

When the detected flammable-gas concentration H is below a reference value, the flow-rate control unit 106 controls the flow of the object fluid such that a specified amount of object fluid is fed (step S46), and, at the same time, the control unit 106 causes a specified amount of the flammable gas to be fed (step S47).

As apparent from the above, it is possible to determine that the supplied flammable gas has been completely oxidized and that part of the catalyst has reached the activation temperature by detecting an abrupt drop in the flammable-gas concentration H. Therefore, controlling the flow rates of the object fluid and the flammable gas based on whether or not the flammable-gas concentration H has fallen below a predetermined concentration provides the same advantage of rapidly making the entire catalyst-carrying heat exchanger active, which makes the heater active in a short period of time.

Seventh Embodiment

Figure 18:
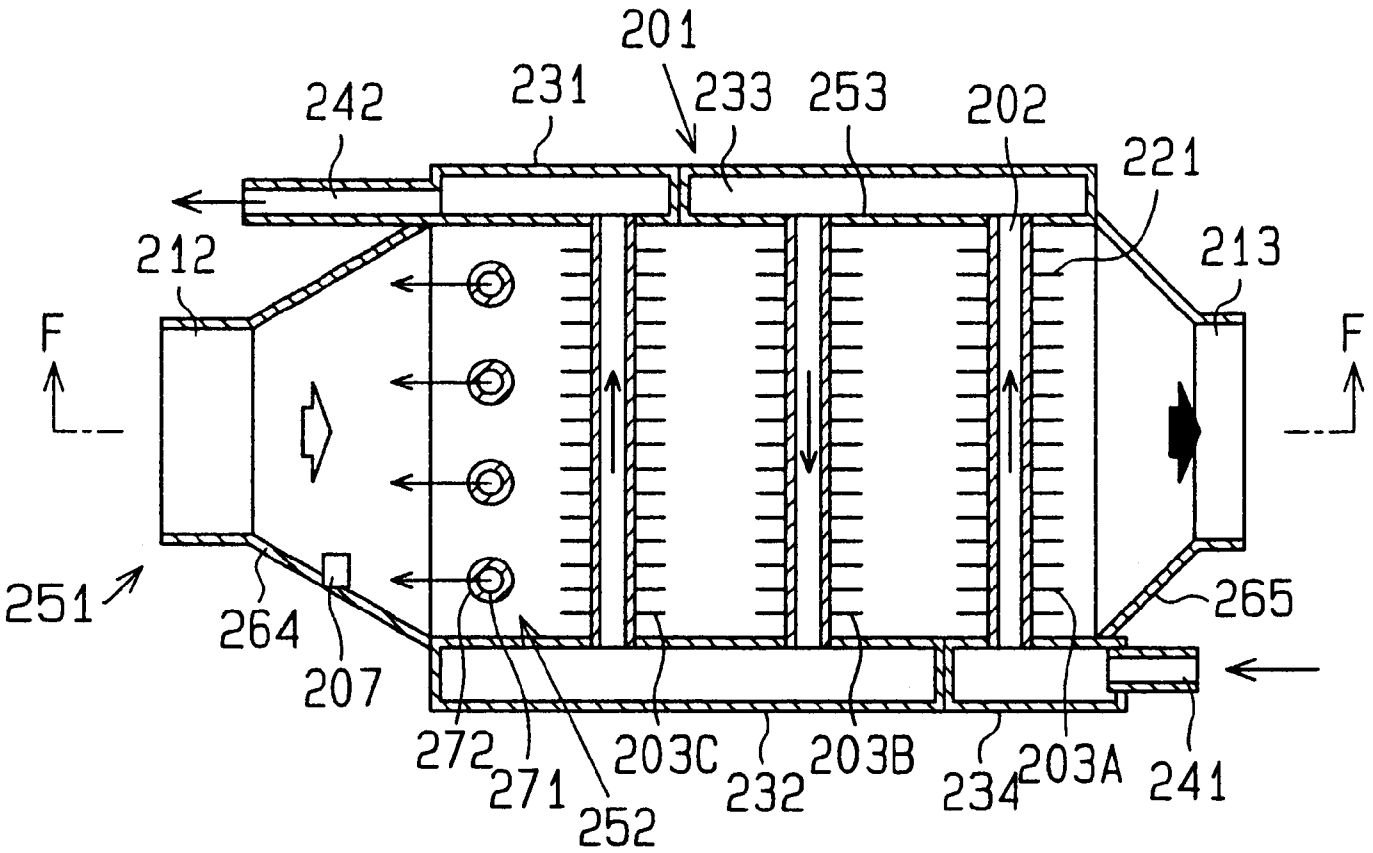
FIG. 18 is a diagram showing a catalyst-carrying heat exchanger 201, which is a catalytic combustion heater according to a seventh embodiment.
Figure 19:
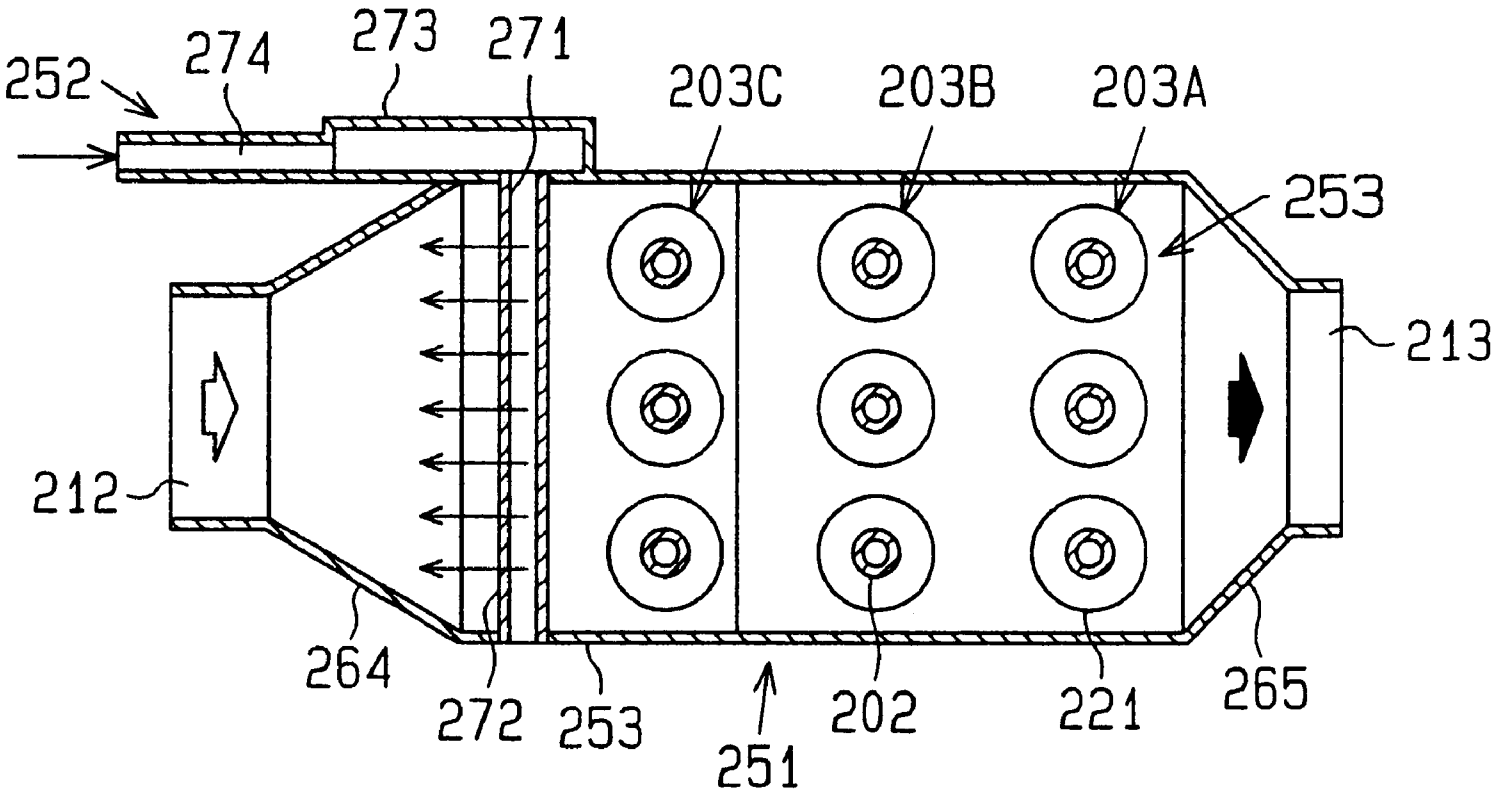
FIG. 19 is a diagram depicting a cross section when the catalyst-carrying heat exchanger 201 shown in FIG. 18 is cut along the line F—F.

FIG. 18 is a diagram showing a catalyst-carrying heat exchanger 201, which is a catalytic combustion heater according to the seventh embodiment. FIG. 19 is a diagram depicting a cross section when the catalyst-carrying heat exchanger 201 shown in FIG. 18 is cut along the line F—F.

The catalytic combustion heater according to this embodiment includes a housing 251, a fuel-gas feeding section 252 and a catalyst-carrying heat exchanger 201, which are integral.

The housing 251 is a cylinder having a rectangular cross section, both ends of which are open. The housing 251 has a center portion 253, which occupies more than half of the entire length and has equal side lengths. Both end portions 264 and 265 are trapezoidal and become narrower toward the open ends 212, 213. Thus, the ends will be called trapezoidal portions 264 and 265.

One open end 212 of the housing 251 is called a combustion support-gas feed port 212. A combustion support gas such as air is fed into the housing 251 through the open end 212. The other open end 213 of the housing 251 is called an exhaust port 213. The exhaust gas combustion is discharged, and a gas flow extending from the combustion support-gas feed port 212 to the exhaust port 213 is formed in the housing 251.

The fuel-gas feeding section 252 has a plurality of closed tube portions 271, which are arranged close to the trapezoidal portion 264, in the center portion 253 of the housing 251. The tube portions 271 are side by side in a direction perpendicular to the axis of the housing 251 and bridge the opposing walls of the housing 251. The distal ends of the tubes 271 communicate with a common tube joining section 273 provided on the outer wall surface of the housing 251.

The tube joining section 273 is connected to a pipe 274 for feeding a fuel gas such as hydrogen so that the fuel gas is distributed to the individual tube portions 271 via the tube joining section 273. Each tube portion 271 has a plurality of injection ports 272 formed on the side of the tube portion that faces the combustion support-gas feed port 212, and the fuel gas is injected through the injection ports toward the trapezoidal portion 264 against the flow of the combustion support gas flowing through the combustion support-gas feed port 212. The combustion support gas and the fuel gas are well mixed in the vicinity of the injection ports 272. The gas mixture forms a mixed gas flow the upstream portion of which is near the injection ports 272. The mixture flows downstream where the catalyst-carrying heat exchanger 201 is located.

The catalyst-carrying heat exchanger 201 has multiple tubes 202 located closer to the downstream end of the gas flow than the tube portions 271 of the fuel feeding section 2.

The multiple tubes 202 are arranged in rows in the direction of the axis of the housing 251, and the individual rows 203A, 203B and 203C of the tubes 202 are arranged side by side in a direction perpendicular to the axis of the housing 251 and the tube portions 271 of the fuel-gas feeding section 2.

The rows 203A, 203B and 203C of the tubes 202 are coupled by tube joining sections 234, 233, 232 and 231, to form a single tube passage. The object fluid, such as water, is supplied to the tube joining section 234, which is at one end of the single tube passage, from an inlet passage 241. The flow of the object fluid is directed toward the upstream end from the downstream end of the gas flow as indicated by the arrows in FIGS. 18 and 19.

The object fluid is supplied to an outlet passage 242, which communicates with the tube joining section 231 and flows the other end of the single tube passage. The object fluid is used for heating.

Multiple fins 221, which form a catalyst section, are joined to the outer surface of each tube 202 by brazing or the like. The fins 221 are formed by a flat, annular plate, and an oxidation catalyst such as platinum or palladium is carried on the outer surfaces of the fins.

The outside diameter and number of the fins 221 are set in accordance with the amount of heat needed for the object fluid that flows in the joined tubes 202.

In the catalyst-carrying heat exchanger 201, the fuel gas, which forms part of a gas mixture, flows toward the exhaust port 253 while undergoing catalytic combustion by the action of the oxidation catalyst on the fins 221. The combustion heat produced by the catalytic combustion is transferred to the tubes 202 from the fins 221 to heat the object fluid that flows inside via the tube walls. The exhaust gas is discharged from the exhaust port 213.

The advancing direction of the object fluid is opposite to the flow direction of the gas, and the object fluid that flows in the tubes 202 of the row 203A close to the inlet port 241 has a low temperature and efficiently receives heat from the exhaust gas, which has a relatively high temperature, immediately before the exhaust gas is discharged from the exhaust port 213. As the object fluid flows to the upstream end of the gas flow, it is heated, and the object fluid that flows inside the tubes 202 in the upstream row 203C of the gas flow becomes hottest, thus ensuring efficient heat transfer.

A temperature sensor 207, such as a temperature measuring resistor, which serves as a temperature detecting section, is provided in a middle portion of the trapezoidal portion 264. The temperature sensor 207 is securely embedded in an attachment hole formed in the wall of the housing 251 and detects the inner temperature of the housing 251 at the trapezoidal portion 264. Its detection signal is input to a computer, which controls the entire heater, including the flow rates of the fuel gas and combustion support gas. The computer stores the inner temperature of the housing 251 at the trapezoidal portion 264 when vapor phase combustion has occurred as a threshold value for determining the presence/absence of vapor phase combustion and determines if there is vapor phase combustion by comparing the detected temperature with the threshold value.

The operation of the above-described catalytic combustion heater will now be described. When catalytic combustion is carried out normally, the tubes 202 and fins 221 of the catalyst-carrying heat exchanger 201 have lower temperatures than at the time of vapor phase combustion, and since catalytic combustion takes place on the surfaces of the fins 221, the combustion heat is transferred to the tubes 202 from the fins 221 to achieve efficient heat transfer with the object fluid that flows in the tubes 202. Therefore, the overall inner temperature of the housing 251 does not rise much. Further, upstream of the tubes 202, such as at the locations of the trapezoidal portion 264, where the temperature sensor 207 is located, the combustion support gas flows and the combustion support gas and the fuel gas are mixed, so that the temperature detected by the temperature sensor 207 is low and stable even when the combustion output changes.

While catalytic combustion takes place on the surfaces of the fins 221 of the layers 203A, 203B and 203C, the largest amount of heat is generated in the upstream row 203C because the concentration of the gas mixture is higher at the upstream end of the gas flow, and the upstream-side row 203C of the gas flow is likely to become abnormally hot due to an insufficient supply of the combustion support gas. Because the direction of the flow of the object fluid is opposite to that of the gas flow in this embodiment, the temperature of the object fluid that flows in the tubes 202 of the upstream row 203C of the gas flow is the highest. When the gas flow at upstream row 203C becomes abnormally hot and the gas mixture is ignited, a flame is produced in the vicinity of the injection ports 272 of the fuel feeding section 2, which is located upstream of the gas mixture stream.

Being exposed to this flame, the temperature of the trapezoidal portion 264 of the housing 251 near the injection ports 272 of the fuel feeding section 2 rises due to the combustion heat and becomes considerably high because the combustion temperature is high in vapor phase combustion. As the vapor phase combustion occurs, even the fins 221 in the upstream-side row 203C of the gas flow cannot receive heat efficiently, thus limiting a temperature rise.

Therefore, while a conventional heater with a temperature sensor provided on the fins 221 has a difficulty in detecting vapor phase combustion, the temperature sensor 207 is attached to the trapezoidal portion 264 in this embodiment, so that even if only the fins 221 of the upstream row 203C becomes abnormally hot, the temperature sensor is exposed to a flame and the detected temperature rises in accordance with the combustion temperature of vapor phase combustion, and the computer determines the occurrence of vapor phase combustion when the temperature exceeds a predetermined threshold value as mentioned above. Since the temperature sensor 207 is provided at the position where a temperature difference between catalytic combustion and vapor phase combustion becomes apparent, the sensitivity of detecting vapor phase combustion is high. It is therefore possible to detect vapor phase combustion with high reliability.

Although the temperature sensor 207 is provided at the trapezoidal portion 264 of the housing 251 in this embodiment, the position of the temperature sensor 207 is not so limited. The temperature sensor 207 needs only to be located at a position close to the injection ports 272 of the fuel-gas feeding section 252 and can be located more upstream in the gas flow than the tubes 202. For example, it may be provided on the tube portions 271, which are projections of the fuel-gas feeding section 252 and which protrude inside the housing 251.

This embodiment may be adapted to a heater in which the direction of the flow of the object fluid is the same as that of the gas flow.

A catalytic combustion heater according to the present invention has a detecting section for detecting whether or not a combustion exhaust gas in the fuel-gas flow passage is at a dew-point temperature and a control section for controlling the feed rate of the combustion support gas or the flammable gas supplied to the fuel-gas flow passage, based on the result of detection done by the detecting section.

The ratio of vapor contained in the combustion exhaust gas and the temperature at which the vapor condenses (dew-point temperature) are determined by the composition of the fuel gas to be supplied, and it is possible to prevent vapor from condensing on the surface of the catalyst if the surface temperature of the catalyst in the heat exchanger is equal to or higher than the dew-point temperature at the time of the combustion of the fuel gas. As the feed rate of the combustion support gas is increased, part of the heat generated by the oxidation reaction is carried downstream with the flow-speed increased fuel gas and combustion exhaust gas as a carrier, thereby increasing the inner temperature of the heat exchanger. It is therefore possible to prevent condensation of vapor, reduction of the catalyst activity and discharge of unburned gas by detecting whether or not the combustion exhaust gas in the fuel-gas flow passage is at the dew-point temperature and causing the control section to increase the feed rate of the combustion support gas when the temperature becomes equal to or lower than the dew-point temperature, so that the temperature of the combustion exhaust gas or the surface temperature of the catalyst remains equal to or higher than the dew-point temperature.

As the feed rate of the flammable gas is increased, the oxidation reaction is accelerated to increase the heat generated on the catalyst surface, thereby increasing the inner temperature of the heat exchanger. Therefore, the same advantage of preventing condensation of vapor results also by detecting whether or not the combustion exhaust gas in the fuel-gas flow passage is at the dew-point temperature and causing the control section to increase the feed rate of the flammable gas at the downstream end of the fuel-gas flow passage when the temperature becomes equal to or lower than the dew-point temperature. This can control the performance of the catalyst so that both reliability and efficient heat transfer are achieved.

The detecting section of the catalytic combustion heater of the present invention may be a temperature detecting section for detecting the temperature of the combustion exhaust gas or a temperature detecting section for detecting temperatures of the outer surfaces of the tubes. It is possible to detect whether or not the surface temperature of the catalyst is the dew-point temperature by detecting the temperature of the combustion exhaust gas or the temperature of the outer surface of the tubes.

The detecting section of the catalytic combustion heater of the present invention may be provided in the vicinity of an outlet of the fuel-gas flow passage. Since the surface temperature of the catalyst in the heat exchanger is the lowest near the outlet of the fuel-gas flow passage, it is possible to detect whether or not the entire catalyst in the heat exchanger has reached the dew-point temperature by detecting the temperature at this location.

In the catalytic combustion heater of the present invention, the oxidation catalyst may be carried by fins joined to the outer surface of the tubes. In this case, the same advantage can be achieved for detecting the temperatures of the outer surfaces of the tubes to detect the surface temperatures of the fins in the vicinity of the outlet of the fuel-gas flow passage and causing the control section to control the feed rate of the combustion support gas or the feed rate of the flammable gas.

In the catalytic combustion heater of the present invention, when the detecting section outputs a detection result such that the temperature of the combustion exhaust gas in the fuel-gas flow passage is equal to or lower than a dew-point temperature, the control section may increase the feed rate of the combustion support gas to raise the temperature of the combustion exhaust gas to or above the dew-point temperature. The aforementioned problems can be overcome by inputting the aforementioned detection result to the control section whenever necessary and promptly increasing the feed rate of the combustion support gas when the temperature of the combustion exhaust gas becomes equal to or lower than the dew-point temperature.

In the catalytic combustion heater of the present invention, when the detecting section outputs a detection result indicating that the temperature of the combustion exhaust gas in the fuel-gas flow passage is equal to or lower than the dew-point temperature, the control section may perform such control as to increase the feed rate of the flammable gas toward the downstream side of the fuel-gas flow passage in order to raise the temperature of the combustion exhaust gas to or above the dew-point temperature. In this case too, the aforementioned advantage can be obtained easily by inputting the aforementioned detection result to the control section whenever necessary and promptly increasing the feed rate of the flammable gas toward the downstream side when the temperature of the combustion exhaust gas becomes equal to or lower than the dew-point temperature.

The catalytic combustion heater of the present invention may further include an flammable-gas feeding section having a plurality of flammable-gas feed ports for distributing the flammable gas upstream and downstream of the fuel-gas flow passage and a valve member, located in the flammable-gas feeding section, for regulating the flow rate of the flammable gas supplied downstream of the fuel-gas flow passage, and the control section adjusts the valve angle of the valve member. Accordingly, the control section adjusts the valve angle of the valve member so that when the temperature of the combustion exhaust gas becomes equal to or lower than the dew-point temperature, the amount of the flammable gas to be supplied downstream of the fuel-gas flow passage from the downstream flammable-gas feed port can be increased by increasing the valve angle.

In the catalytic combustion heater of the present invention, the flow direction of the fuel gas may be opposite to the flow direction of the object fluid. Prevention of condensation is particularly effective in the above-described structure where cool object fluid is supplied to the outlet of the combustion exhaust gas.

In the catalytic combustion heater of the present invention, the combustion support gas may be air. As the combustion support gas for oxidizing the flammable gas, air is the most ordinary and economical.

Another catalytic combustion heater according to the present invention includes a control section for controlling at least one of the feed rates of the combustion support gas and the flammable gas supplied to the fuel-gas flow passage, based on the result of detection by a detecting section for detecting the concentration of nitrogen oxide in the combustion exhaust gas in the fuel-gas flow passage.

When a flame is produced in the catalytic combustion unit, a nitrogen oxide, which would not be produced in normal catalytic combustion, is produced. The oxidation reaction by the catalyst occurs at a lower temperature than that of the flame-producing combustion, so that an oxidation reaction is possible even with lean fuel gas that does not produce a flame.

That is, it is possible to detect the production of a flame by detecting nitrogen oxide in the combustion exhaust gas by using the detecting section for detecting a nitrogen oxide component. At this time, it is possible to prevent a flame from being produced by reducing the feed rate of the flammable gas in the fuel gas or increasing the feed rate of the combustion support gas. It is therefore possible to prevent the deterioration of the catalyst, thereby maintaining the performance of the catalyst, so that both efficient heat transfer and reliability are achieved.

In this catalytic combustion heater according to the present invention, the detecting section may be provided in the vicinity of the outlet of the fuel-gas flow passage. This ensures the detection of the production of a flame in the catalytic combustion unit.

In this catalytic combustion heater according to the present invention, when the detecting section detects that the concentration of nitrogen oxide is equal to or higher than a given value, the control section may decrease the feed rate of the flammable gas or increase the feed rate of the combustion support gas. Flame burning cannot continue and production of a new flame can be prevented if the feed rate of the combustion support gas is increased to make the fuel gas leaner or if the feed rate of the flammable gas is reduced or stopped.

In a further catalytic combustion heater according to the present invention, the passage resistances of a plurality of flammable-gas feeding passages are set such that when the amount of heat generated downstream of the fuel-gas flow passage reaches the minimum output of the catalytic combustion heater, the temperature of the combustion exhaust gas in the fuel-gas flow passage becomes equal to or higher than a dew-point temperature.

By providing a plurality of flammable-gas feeding passages to directly feed part of the flammable gas downstream of the fuel-gas flow passage, it is possible to accelerate oxidation reaction downstream and increase the heat generated on the catalyst's surface. By adjusting the passage resistances of the plurality of flammable-gas feeding passages so that a predetermined amount or a greater amount of flammable gas is supplied via the flammable-gas feeding passages at the downstream end when the output of the heater is a minimum, therefore, it is possible to raise the surface temperature of the catalyst to or above the dew-point temperature of the combustion exhaust gas, thereby preventing condensation of vapor. Further, because the detecting section for detecting whether or not the combustion exhaust gas is at the dew-point temperature and the section for controlling the feed rate of the flammable gas or the combustion support gas are not required, it is possible to prevent the catalyst activity from deteriorating and to prevent discharge of unburned gas with a simpler structure.

A different catalytic combustion heater according to the present invention includes a flow-rate control section for controlling the flow rate of the flammable gas based on the result of detection done by a detecting section for detecting the temperature of the combustion exhaust gas or the concentration of the flammable gas in the vicinity of the outlet of the fuel-gas flow passage.

In the catalytic combustion, when the catalyst temperature rises to approximately 60% of the activation temperature for completely oxidizing flammable gas, the quantity of which corresponds to the reaction area, the reaction becomes active thereafter in accordance with an increase in the fuel. Further, if part of the catalyst-carrying heat exchanger becomes sufficiently active, the ambient catalyst spontaneously reaches the activation temperature by the movement of radiation heat or the heat that is carried by the combustion gas. Therefore, this different catalytic combustion heater of the present invention determines the activation state of the catalyst in the catalyst-carrying heat exchanger using the aforementioned detecting means and controls the feed rate of the flammable gas accordingly. For example, if the proportion of the flammable gas is very small with respect to the combustion support gas, even if unburned gas rapidly causes a reaction downstream in the fuel-gas flow passage, ignition does not occur. If the flow rate of the flammable gas is small, the flammable gas flows downstream while gradually reacting, and there is no extreme blow-by of the flammable gas.

When the amount of the flammable gas is small with respect to the amount of the combustion support gas, the temperature increase of the combustion exhaust gas cannot be confirmed clearly unless the flammable gas is completely oxidized. That is, if the temperature of the combustion exhaust gas clearly starts rising, it is possible that the supplied flammable gas has been oxidized completely and part of the catalyst has reached the activation temperature. Or, if the concentration of the flammable gas drops abruptly, it is possible that the supplied flammable gas has been oxidized completely and part of the catalyst has reached the activation temperature. Therefore, by causing the aforementioned flow-rate control means to reduce the flow rate of the flammable gas until those states are detected and to increase the flow rate of the flammable gas when those states are detected, the entire catalyst-carrying heat exchanger can be made active quickly by effectively using the generated heat. It is thus possible to provide a catalytic combustion heater with a simple structure that does not monitor multiple temperatures, prevents the discharge of unburned gas, prevents ignition or the like, is safe, and has a short activation time.

In this catalytic combustion heater according to the present invention, the flow-rate control section may make the flow rate of the flammable gas lower than that of the combustion support gas until the temperature of the combustion exhaust gas detected by the detecting section exceeds a predetermined temperature or until the concentration of the flammable gas becomes lower than a predetermined concentration, and the flow-rate control section may increase the flow-rate of the flammable gas to a predetermined amount when the temperature of the combustion exhaust gas exceeds the predetermined temperature or when the concentration of the flammable gas becomes lower than the predetermined concentration.

Specifically, if the temperature of the combustion exhaust gas clearly starts rising and it is confirmed that the temperature exceeds a predetermined temperature, it is possible that the supplied flammable gas has been oxidized completely and part of the catalyst has reached the activation temperature. Or, if the concentration of the flammable gas drops abruptly and falls below a predetermined temperature, it is possible that the supplied flammable gas has been oxidized completely and part of the catalyst has reached the activation temperature. In this respect, it is detected whether or not the temperature of the combustion exhaust gas has exceeded the predetermined temperature or whether or not the concentration of the flammable gas has fallen below the predetermined concentration. If the proportion of the flammable gas is sufficiently small, there is no danger even if the flammable gas spontaneously reacts downstream, thus ensuring safety.

In this catalytic combustion heater, according to the present invention, the catalyst-carrying heat exchanger may have a fuel distributing section for distributing and feeding the flammable gas, the amount corresponds to the state of the object fluid flowing in the tubes, to individual portions of the tubes.

With the structure where the flammable gas is separately fed into the fuel-gas flow passage in accordance with the state of the object fluid in the tubes, a given proportion of flammable gas is always supplied to the downstream tubes so that the fuel gas is likely to have a high concentration at the downstream end, as compared with the structure where the mixture of the flammable gas and the combustion support gas is supplied at the upstream end of the fuel-gas flow passage. Even in this catalytic combustion heater of the present invention, the flow-rate control means controls the flow rate of the flammable gas based on the detection result from the detecting means so that the quick activation of the catalyst can be accomplished safely. In this structure, by separating feeding the flammable gas and feeding the necessary amounts of flammable gas to the individual portions of the tubes during steady combustion, the catalytic combustion is efficient while local overheating of the fins and tubes is prevented, thus improving the heat transfer efficiency.

In a still different catalytic combustion heater according to the present invention, a temperature detecting section is provided in the housing in the vicinity of the injection port and closer to the one open end than to the tubes.

When part of the catalyst becomes abnormally hot and the gas mixture is ignited, vapor phase combustion occurs in the vicinity of the injection port that is at the upstream end of the gas mixture flow. Therefore, being exposed to the flame, the detected temperature of the temperature detecting means, which is provided in the vicinity of the injection port, always rises to a temperature according to the high combustion temperature of vapor phase combustion. The temperature detecting means detects the occurrence of vapor phase combustion even if the vapor phase combustion is caused by the abnormally high temperature of part of the catalyst section. Further, because the temperature detector is closer to the open end than to the tubes and is close to the injection port is where the fuel gas and the combustion support gas are present before combustion during normal catalytic combustion, the temperature is considerably lower than that of the catalyst-carrying heat exchanger. Therefore, the range of a temperature rise of the detected temperature at the time vapor phase combustion occurs is large and the detection sensitivity is excellent. This permits the occurrence of vapor phase combustion to be detected with high precision.

In the still different catalytic combustion heater according to the present invention, the temperature detecting section is provided on a projection of the fuel-gas feeding section protruding into the housing.

What is claimed is:

1. A catalytic combustion heat exchanger:

a fuel-gas flow passage located in the heat exchanger, wherein a flammable gas and a combustion support gas are components of a fuel gas that flows in the fuel-gas flow passage, wherein the fuel-gas flow passage has an outlet;

a tube, at least a part of which is located in the flow passage, for conducting an object fluid through the heat exchanger, wherein an oxidation catalyst is located on a surface of the tube within the flow passage for causing an oxidation reaction when the fuel gas contacts the oxidation catalyst, and heat from the reaction heats the object fluid, and an exhaust gas flows in a downstream end of the flow passage and through the outlet;

a detector for detecting the temperature of the exhaust gas in the vicinity of the outlet;

a controller for controlling the flow rate of the flammable gas based on the result of the detection; and a flammable gas feeder for delivering the flammable gas to the flow passage, wherein the amount of gas delivered to the flow passage depends on the state of the object fluid in the tube.

2. The catalytic heat exchanger of claim 1, wherein the controller decreases the flow rate of the flammable gas with respect to that of the combustion support gas until the temperature of the exhaust gas exceeds a predetermined temperature, and the controller increases the flow rate of the flammable gas with respect to that of the combustion support gas when the temperature of the exhaust gas exceeds a certain temperature.

3. A catalytic combustion heat exchanger:

a fuel-gas flow passage located in the heat exchanger, wherein a flammable gas and a combustion support gas are components of a fuel gas that flows in the fuel-gas flow passage, wherein the fuel-gas flow passage has an outlet;

a tube, at least a part of which is located in the flow passage, for conducting an object fluid through the heat exchanger, wherein an oxidation catalyst is located on a surface of the tube within the flow passage for causing an oxidation reaction when the fuel gas contacts the oxidation catalyst, and heat from the reaction heats the object fluid, and an exhaust gas flows in a downstream end of the flow passage and through the outlet;

a detector for detecting the temperature of the exhaust gas in the vicinity of the outlet; and a controller for controlling the flow rate of the flammable gas based on the result of the detection, wherein the controller decreases the flow rate of the flammable gas with respect to that of the combustion support gas until the temperature of the exhaust gas exceeds a predetermined temperature, and the controller increases the flow rate of the flammable gas with respect to that of the combustion support gas when the temperature of the exhaust gas exceeds a certain temperature.

4. A catalytic combustion heat exchanger:

a fuel-gas flow passage located in the heat exchanger, wherein a flammable gas and a combustion support gas are components of a fuel gas that flows in the fuel-gas flow passage, wherein the fuel-gas flow passage has an outlet;

a tube, at least a part of which is located in the flow passage, for conducting an object fluid through the heat exchanger, wherein an oxidation catalyst is located on a surface of the tube within the flow passage for causing an oxidation reaction when the fuel gas contacts the oxidation catalyst, and heat from the reaction heats the object fluid, and an exhaust gas flows in a downstream end of the flow passage and through the outlet;

a detector for detecting the state of the exhaust gas in the vicinity of the outlet;

a controller for controlling the flow rate of the flammable gas based on the result of the detection; and a flammable gas feeder for delivering the flammable gas to the flow passage, wherein the amount of gas delivered to the flow passage depends on the state of the object fluid in the tube.

* * * * *

UNITED STATES PATENT AND TRADEMARK OFFICE

CERTIFICATE OF CORRECTION

PATENT NO. : 6,397,787 B1
DATED : June 4, 2002
INVENTOR(S) : Yamada et al.

It is certified that error appears in the above-identified patent and that said Letters Patent is hereby corrected as shown below:

Title page,
Items [86] and [87] have been omitted.
Item [22] and the PCT information should read:

-- [22] PCT Filed: October 16, 1998
[86] PCT No.: PCT/JP98/04690

§ 371 (c)(1)
(2), (4) Date: Jun. 15, 2000

[87] PCT Pub. No.: WO99/20947

PCT Pub. Date: Apr. 29, 1999 --

Signed and Sealed this

Tenth Day of December, 2002

JAMES E. ROGAN
*Director of the United States Patent and Trademark Office*